US009177512B2

(12) United States Patent
Ueki et al.

(10) Patent No.: US 9,177,512 B2
(45) **Date of Patent: *Nov. 3, 2015**

(54) DISPLAY DEVICE

(75) Inventors: Shun Ueki, Osaka (JP); Kohzoh Nakamura, Osaka (JP); Kazunari Tomizawa, Osaka (JP); Tomohiko Mori, Osaka (JP); Yuichi Yoshida, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 348 days.

This patent is subject to a terminal disclaimer.

(21) Appl. No.: 13/578,633

(22) PCT Filed: Feb. 8, 2011

(86) PCT No.: PCT/JP2011/052587

§ 371 (c)(1),
(2), (4) Date: Aug. 13, 2012

(87) PCT Pub. No.: WO2011/102260

PCT Pub. Date: Aug. 25, 2011

(65) Prior Publication Data

US 2012/0313981 A1 Dec. 13, 2012

(30) Foreign Application Priority Data

Feb. 19, 2010 (JP) ..... 2010-034372

(51) Int. Cl.

| | |
|---|---|
| ***G09G 5/10*** | (2006.01) |
| ***G09G 3/36*** | (2006.01) |
| *G09G 3/20* | (2006.01) |

(52) U.S. Cl.

CPC ..... *G09G 3/3607* (2013.01); *G09G 3/2003* (2013.01); *G09G 2300/0452* (2013.01); *G09G 2340/06* (2013.01)

(58) Field of Classification Search

USPC ..... 345/690

See application file for complete search history.

(56) References Cited

U.S. PATENT DOCUMENTS

| | | | |
|---|---|---|---|
| 4,800,375 | A | 1/1989 | Silverstein et al. |
| 6,661,488 | B1 | 12/2003 | Takeda et al. |

(Continued)

FOREIGN PATENT DOCUMENTS

| | | | |
|---|---|---|---|
| JP | 09-251160 | A | 9/1997 |
| JP | 11-242225 | A | 9/1999 |

(Continued)

OTHER PUBLICATIONS

Official Communication issued in corresponding European Patent Application No. 12179586.8, mailed on Oct. 29, 2012.

(Continued)

*Primary Examiner* — Van Chow

(74) *Attorney, Agent, or Firm* — Keating & Bennett, LLP

(57) ABSTRACT

A display device (100) according to the present invention includes a pixel defined by a plurality of sub pixels. The plurality of sub pixels are a red sub pixel (R) to display red, a green sub pixel (G) to display green, a blue sub pixel (B) to display blue, and a yellow sub pixel (Ye) to display yellow. When an input signal corresponding to green of the sRGB color space is externally input, the display device (100) according to the present invention provides display by use of the green sub pixel (G) and also the yellow sub pixel (Ye). According to the present invention, a multiple primary color display device which suppresses decline of the display quality when an input signal corresponding to green of the sRGB color space is externally input is provided.

20 Claims, 15 Drawing Sheets

(56) References Cited

U.S. PATENT DOCUMENTS

| | | | | |
|---|---|---|---|---|
| 6,710,825 | B2 | 3/2004 | Kubo et al. | |
| 6,952,252 | B2 | 10/2005 | Nakanishi | |
| 6,977,704 | B2 | 12/2005 | Kataoka | |
| 7,268,757 | B2 | 9/2007 | Ben-David et al. | |
| 7,545,395 | B2 * | 6/2009 | Kurumisawa | 345/690 |
| 8,436,875 | B2 * | 5/2013 | Ueki et al. | 345/690 |
| 2004/0174389 | A1 | 9/2004 | Ben-David et al. | |
| 2005/0122294 | A1 | 6/2005 | Ben-David et al. | |
| 2006/0055858 | A1 | 3/2006 | Nakanishi et al. | |
| 2009/0167657 | A1 | 7/2009 | Tomizawa | |
| 2010/0026728 | A1 | 2/2010 | Miyazaki et al. | |
| 2011/0128309 | A1 | 6/2011 | Miyazaki et al. | |
| 2011/0216109 | A1 * | 9/2011 | Ueki et al. | 345/690 |
| 2012/0320115 | A1 * | 12/2012 | Ben-David et al. | 345/694 |

FOREIGN PATENT DOCUMENTS

| | | | |
|---|---|---|---|
| JP | 2001-209047 | A | 8/2001 |
| JP | 2001-306023 | A | 11/2001 |
| JP | 2001-312254 | A | 11/2001 |
| JP | 2002-357830 | A | 12/2002 |
| JP | 2003-043525 | A | 2/2003 |
| JP | 2003-177418 | A | 6/2003 |
| JP | 2004-529396 | A | 9/2004 |
| JP | 2006-078968 | A | 3/2006 |
| JP | 2008-065174 | A | 3/2008 |
| JP | 2009-251077 | A | 10/2009 |
| WO | 2007/097080 | A1 | 8/2007 |
| WO | 2008/012969 | A1 | 1/2008 |
| WO | 2008/047725 | A1 | 4/2008 |
| WO | 2010/013421 | A1 | 2/2010 |
| WO | 2010/055626 | A1 | 5/2010 |

OTHER PUBLICATIONS

English translation of Official Communication issued in corresponding International Application PCT/JP2011/052587, mailed on Sep. 27, 2012.

Ueki et al.; "Display Device"; U.S. Appl. No. 13/128,884, filed May 12, 2011.

Official Communication issued in International Patent Application No. PCT/JP2011/052587, mailed on Mar. 8, 2011.

Yang et al.; "31.1: Development of Six Primary-Color LCD"; Society for Information Display, 2005 International Symposium Digest of Technical Papers; vol. XXXVI, Book II.; May 25-27, 2005; pp. 1210-1213.

Chino et al.; "25.1: Invited Paper: Development of Wide-Color-Gamut Mobile Displays With Four-Primary-Color LCDS"; Society for Information Display, 2006 International Symposium Digest of Technical Papers; vol. XXXVII, Book II; Jun. 7-9, 2006; pp. 1221-1224.

Ben-Chorin; "Improving LCD TV Color Using Multi-Primary Technology", FPD International 2005 Forum; Oct. 19, 2005; Total of 66 pages.

Pointer; "The Gamut of Real Surface Colors", Color Research and Application; vol. 5, No. 3; Fall 1980; pp. 145-155.

* cited by examiner

DISPLAY DEVICE

TECHNICAL FIELD

The present invention relates to a display device, and specifically to a multiple primary color display device which provides display by use of four primary colors.

BACKGROUND ART

Today, various types of display devices are used for various applications. In a general display device, one pixel includes three sub pixels for displaying red, green and blue, which are three primary colors of light, and this realizes color display.

However, conventional display devices have a problem that the range of colors which can be reproduced (referred to as the "color reproduction range") is narrow. FIG. 25 shows a color reproduction range of a conventional display device which provides display by use of the three primary colors. FIG. 25 is an xy chromaticity diagram of an XYZ colorimetric system. The triangle, the apexes of which are three points corresponding to the three primary colors of red, green and blue, represents the color reproduction range. In the figure, colors of various objects existing in the natural world which have been clarified by Pointer (see Non-patent Document 1) are plotted with "x". As can be seen from FIG. 25, there are object colors which are not encompassed in the color reproduction range. The display device which provides display by use of the three primary colors cannot display a part of the object colors.

In order to enlarge the color reproduction range of display devices, techniques for increasing the number of primary colors used for display have been proposed.

For example, as shown in FIG. 26, Patent Document 1 discloses a liquid crystal display device 800 in which one pixel P includes six sub pixels R, G, B, Ye, C and M which respectively display red, green, blue, yellow, cyan and magenta. FIG. 27 shows the color reproduction range of the liquid crystal display device 800. As shown in FIG. 27, the color reproduction range represented by the hexagon, the apexes of which are six points corresponding to the six primary colors substantially encompasses the object colors. As can be seen, the color reproduction range can be enlarged by increasing the number of primary colors used for display.

Patent Document 1 also discloses a liquid crystal display device in which one picture element includes four pixels respectively for displaying red, green, blue and yellow, and a liquid crystal display device in which picture element includes five pixels respectively for displaying red, green, blue, yellow and cyan. By use of four or more primary colors, the reproduction range can be enlarged as compared with that of a conventional display device which provides display by use of the three primary colors. In this specification, a display device which provides display by use of four or more primary colors will be referred to as a "multiple primary color display device", and a liquid crystal display device which provides display by use of four or more primary colors will be referred to as a "multiple primary color liquid crystal display device".

CITATION LIST

Patent Literature

Patent Document 1: PCT Japanese National Phase Laid-Open Patent Publication No. 2004-529396

Non-Patent Literature

Non-patent Document 1: M. R. Pointer, "The gamut of real surface colors," Color Research and Application, Vol. 5, No. 3, pp. 145-155 (1980)

SUMMARY OF INVENTION

Technical Problem

However, as a result of making detailed studies on the display quality of a multiple primary color display device, the present inventors found that a mere increase of the number of primary colors does not provide a sufficiently high display quality. For example, when an input signal corresponding to green of an sRGB color space is externally input, the luminance of green which is actually displayed by the pixel is significantly decreased as compared with the luminance of green which ought to be displayed.

The present invention made in light of the above-described problem has an object of providing a multiple primary color display device which suppresses decrease of the display quality when an input signal corresponding to green of the sRGB color space is externally input.

Solution to Problem

A display device according to the present invention includes a pixel defined by a plurality of sub pixels. The plurality of sub pixels are a red sub pixel to display red, a green sub pixel to display green, a blue sub pixel to display blue, and a yellow sub pixel to display yellow; and when an input signal corresponding to green of an sRGB color space is externally input, display is provided by use of the green sub pixel and the yellow sub pixel.

In a preferable embodiment, increase ratios of gray scale levels of the green sub pixel and the yellow sub pixel with respect to an increase of the gray scale level of the input signal is different between in a first range of the gray scale level of the input signal from a minimum level to a prescribed intermediate level and in a second range of the gray scale level of the input signal from the prescribed intermediate level to a maximum level.

In a preferable embodiment, when the gray scale level of the input signal is the prescribed intermediate level, the gray scale level of the green sub pixel is the maximum level, and the increase ratio of the green sub pixel in the second range is zero.

In a preferable embodiment, in the first range, hue, chroma and lightness of green corresponding to the input signal substantially match the hue, chroma and lightness of a color displayed by the pixel.

In a preferable embodiment, in the second range, the lightness of the green corresponding to the input signal substantially matches the lightness of the color displayed by the pixel.

In a preferable embodiment, in the second range, the hue of the green corresponding to the input signal substantially matches the hue of the color displayed by the pixel.

In a preferable embodiment, when the input signal is input, in the second range, the display device according to the present invention provides display by use of the green sub pixel, the yellow sub pixel and the blue sub pixel.

In a preferable embodiment, when the input signal is input, in the second range, the display device according to the present invention does not use the blue sub pixel for display.

In a preferable embodiment, in the second range, the lightness of the color displayed by the pixel is lower than the lightness of the green corresponding to the input signal.

In a preferable embodiment, in the second range, the hue of the green corresponding to the input signal substantially matches the hue of the color displayed by the pixel.

In a preferable embodiment, in the second range, the hue, chroma and lightness of the color displayed by the pixel are constant.

In a preferable embodiment, in the second range, the increase ratio of the yellow sub pixel is zero.

In a preferable embodiment, the prescribed intermediate level is a gray scale level at which, when a Y value of white displayed by the pixel in an XYZ colorimetric system is 1, the Y value of green corresponding to the input signal is 0.3 or greater.

Alternatively, a display device according to the present invention includes a pixel defined by a plurality of sub pixels. The plurality of sub pixels are a red sub pixel to display red, a green sub pixel to display green, a blue sub pixel to display blue, and a yellow sub pixel to display yellow; and when an input signal corresponding to green of an sRGB color space is externally input, display is provided by use of the green sub pixel in a first range of a gray scale level of the input signal from a minimum level to a prescribed intermediate level, and display is provided by use of the green sub pixel and the yellow sub pixel in a second range of the gray scale level of the input signal from the prescribed intermediate level to a maximum level.

In a preferable embodiment, an increase ratio of the gray scale level of the green sub pixel with respect to an increase of the gray scale level of the input signal is different between in the first range and in the second range.

In a preferable embodiment, when the gray scale level of the input signal is the prescribed intermediate level, the gray scale level of the green sub pixel is the maximum level, and the increase ratio of the green sub pixel in the second range is zero.

In a preferable embodiment, the prescribed intermediate level is a gray scale level at which, when a Y value of white displayed by the pixel in an XYZ colorimetric system is 1, the Y value of green corresponding to the input signal is 0.3 or greater.

In a preferable embodiment, when the prescribed intermediate level is a first intermediate level, an increase ratio of the gray scale level of the green sub pixel with respect to an increase of the gray scale level of the input signal is different between in a third range of the gray scale level of the input signal from the minimum level to a second intermediate level which is higher than the first intermediate level and in a fourth range of the gray scale level of the input signal from the second intermediate level to the maximum level.

In a preferable embodiment, when the gray scale level of the input signal is the second intermediate level, the gray scale level of the green sub pixel is the maximum level, and the increase ratio of the green sub pixel in the fourth range is zero.

In a preferable embodiment, the first intermediate level is a gray scale level at which, when a Y value of white displayed by the pixel in an XYZ colorimetric system is 1, the Y value of the green corresponding to the input signal is 0.3 or greater.

In a preferable embodiment, when the gray scale level of the input signal is a maximum level, chromaticities x and y and a Y value in an XYZ colorimetric system of a color displayed by the pixel fulfill the relationships of $0.25 \leq x \leq 0.35$, $0.45 \leq y \leq 0.70$ and $0.3 \leq Y \leq 0.8$ where the Y value when the pixel displays white is 1.

Advantageous Effects of Invention

The present invention provides a multiple primary color display device which suppresses decrease of the display quality when an input signal corresponding to green of the sRGB color space is externally input.

DESCRIPTION OF EMBODIMENTS

Hereinafter, embodiments of the present invention will be described with reference to the drawings. The present invention is not limited to the following embodiments.

Figure 1:
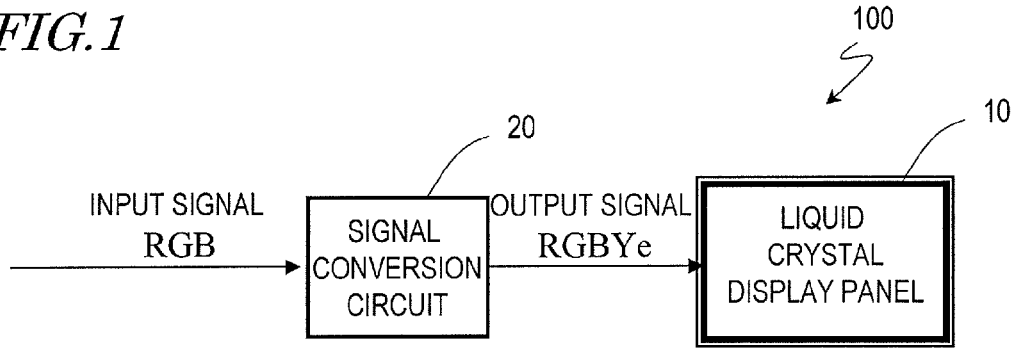
FIG. 1 is a block diagram schematically showing a liquid crystal display device 100 in a preferable embodiment of the present invention.

FIG. 1 shows a liquid crystal display device 100 in this embodiment. As shown in FIG. 1, the liquid crystal display device 100 is a multiple primary color liquid crystal display device including a liquid crystal display panel 10 and a signal conversion circuit 20 and providing display by use of four primary colors.

Figure 2:
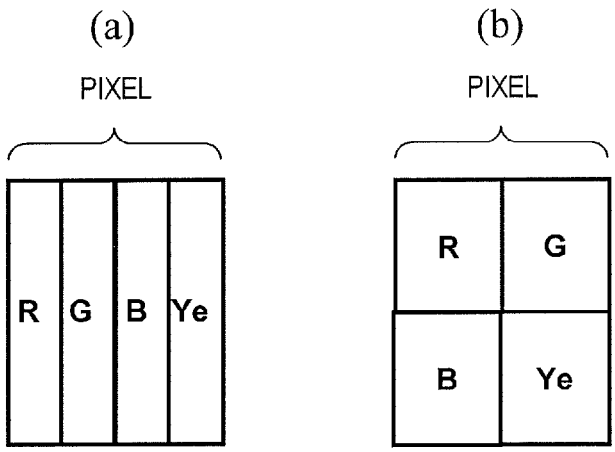
FIGS. 2(*a*) and (*b*) show examples of pixel structure of the liquid crystal display device 100.

The liquid crystal display device 100 includes a plurality of pixels arranged in a matrix. Each of the pixels is defined by a plurality of sub pixels. FIG. 2(*a*) shows a pixel structure of the liquid crystal display device 100. As shown in FIG. 2(*a*), the plurality of sub pixels defining each pixel are a red sub pixel R to display red, a green sub pixel G to display green, a blue sub pixel B to display blue, and a yellow sub pixel Ye to display yellow.

FIG. 2(*a*) shows an example of structure in which the red sub pixel R, the green sub pixel G, the blue sub pixel B and the yellow sub pixel Ye are arranged in this order from left to right in the pixel. The arrangement of the sub pixels in the pixel is not limited to this. The red sub pixel R, the green sub pixel G, the blue sub pixel B and the yellow sub pixel Ye may be arranged in any order in the pixel. These sub pixels do not need to have the same area size. For example, the red sub pixel R and/or the blue sub pixel B may have a larger area size than that of the green sub pixel G and the yellow sub pixel Ye. FIG. 2(*a*) shows a structure in which the four sub pixels are arranged in one row by four columns in the pixel. Alternatively, as shown in FIG. 2(*b*), the red sub pixel R, the green sub pixel G, the blue sub pixel B and the yellow sub pixel Ye may be arranged in two rows by two columns (i.e., in a matrix) in the pixel. In this case also, the plurality of sub pixels defining each pixel do not need to have the same area size. For example, the red sub pixel R and/or the blue sub pixel B may have a larger area size than that of the green sub pixel G and the yellow sub pixel Ye.

The signal conversion circuit 20 converts an input video signal into a multiple primary color signal corresponding to the four primary colors. As shown in, for example, FIG. 1, the signal conversion circuit 20 converts an input signal (video signal) of an RGB format including components representing the luminances of red, green and blue into a multiple primary color signal including components representing the luminances of red, green, blue and yellow. The format of the input signal is not limited to the RGB format, and may be an XYZ format, a YCrCb format or the like.

The liquid crystal display panel 10 receives the multiple primary color signal generated by the signal conversion circuit 20 and displays a color corresponding to the multiple primary color signal by means of each pixel. As the display mode of the liquid crystal display panel 10, any of various display modes is usable. For example, a vertical alignment mode (VA mode), which can realize a wide viewing angle characteristic, is preferably usable.

Specifically, as the vertical alignment mode, an MVA (Multi-domain Vertical Alignment) mode disclosed in Japanese Laid-Open Patent Publication No. 11-242225 or a CPA (Continuous Pinwheel Alignment) mode disclosed in Japanese Laid-Open Patent Publication No. 2003-43525 is usable. A panel of the MVA mode or CPA mode liquid crystal display device includes a liquid crystal layer of a vertical alignment type, in which liquid crystal molecules are aligned vertical to substrates in the absence of a voltage. Display of a wide viewing angle is realized by the liquid crystal molecules being tilted in a plurality of azimuth angles in each sub pixel when a voltage is applied. Needless to say, any other mode such as a TN (twisted nematic) mode, an IPS (In-Plane Switching) mode, an FFS (Fringe Field Switching) mode or the like is usable.

Alternatively, a PSA technology (Polymer Sustained Alignment Technology) is preferably usable. The PSA technology is disclosed in, for example, Japanese Laid-Open Patent Publications Nos. 2002-357830, 2003-177418, and 2006-78968. According to the PSA technology, the pretilt direction of the liquid crystal molecules is controlled as follows. A small amount of polymerizable compound (e.g., a photopolymerizable monomer or oligomer) is mixed in a liquid crystal material. After a liquid crystal cell is assembled, the polymerizable material is irradiated with active energy rays (e.g., ultraviolet rays) in the state where a prescribed voltage is applied to the liquid crystal layer. The pretilt direction of the liquid crystal molecules is controlled by the polymer which is generated. The alignment state of the liquid crystal molecules realized when the polymer is generated is maintained (stored) even after the voltage is removed (in the absence of the voltage). Herein, the layer formed of the polymer will be referred to as an "alignment sustaining layer". The alignment sustaining layer is formed on a surface of each of alignment films (on the liquid crystal layer side). The alignment sustaining layer does not need to be in the form of a film covering the surfaces of the alignment films, and may be in the form of particles of the polymer discretely provided.

The liquid crystal display device 100 in this embodiment has a feature in the manner of display when an input signal corresponding to green of the sRGB color space (substantially the same as green of the EBU format) is externally input. Hereinafter, the input signal corresponding to the green of the sRGB color space will be referred to simply as a "green signal". When the green signal is input to a display device which provides display by use of the three primary colors (three primary color display device), the display is provided such that the luminances of the red sub pixel R and the blue sub pixel B are zero and the luminance of the green sub pixel G is of a prescribed level. Accordingly, the green signal is represented as (R, G, B)=(0, X, 0). Here, X is an integer corresponding to the number of bits of the signal. In this embodiment, 8-bit signals are used, and therefore X is 0 through 255. Hereinafter, the value of X will be referred to also as a "gray scale level of a green signal".

Hereinafter, the manner of display when the green signal is input to the liquid crystal display device 100 in this embodiment will be described specifically. Prior to this, a reason why the luminance of green displayed by the pixel is significantly decreased when the green signal is input to the conventional multiple primary color display device will be described with reference to FIG. 28 through FIG. 30.

Figure 28:
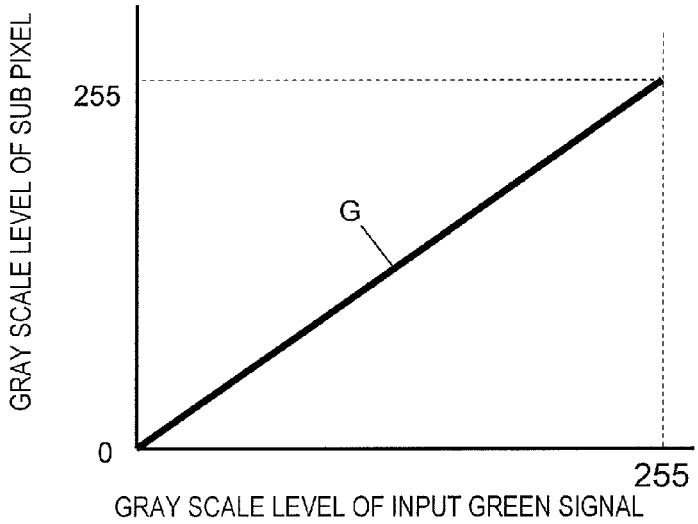
FIG.28 PRIOR ART
FIG. 28 is a graph showing the relationship between the gray scale level of an input green signal (input gray scale level) and the gray scale level of a green sub pixel (output gray scale level) in the conventional example.
Figure 29:
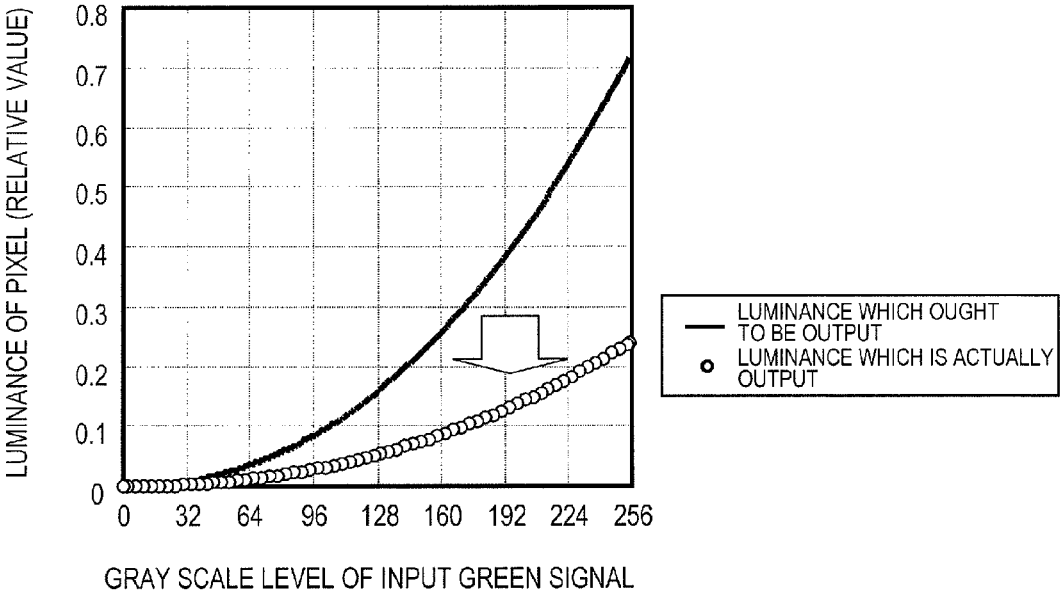
FIG.29 PRIOR ART
FIG. 29 is a graph showing the relationship between the gray scale level of the green signal and the luminance (relative value) of the pixel in the conventional example.
Figure 30:
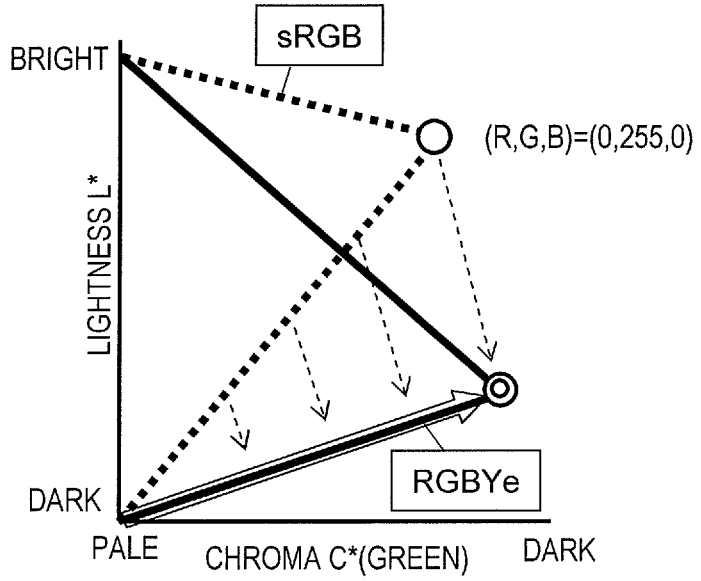
FIG.30 PRIOR ART
FIG. 30 is a graph showing the C*-L* characteristic (relationship between the chroma and the lightness at the hue corresponding to the green of the sRGB color space) of the color displayed by the pixel in the conventional example.

FIG. 28 is a graph showing the relationship between the gray scale level of an input green signal (input gray scale level; X mentioned above) and the gray scale level of the green sub pixel G (output gray scale level). FIG. 29 is a graph showing the relationship between the gray scale level of the input green signal and the luminance (relative value) of the pixel. As the luminance of the pixel, the luminance which ought to be output and the luminance which is actually output are shown (when $\gamma$=2.2). FIG. 30 is a color tone diagram of an L*C*h colorimetric system. In FIG. 30, the horizontal axis represents the chroma C* and the vertical axis represents the lightness L*, regarding the hue angle h corresponding to the green of the sRGB color space. In FIG. 30, the range of the sRGB color space is represented with the dashed line (sRGB), and the color reproduction range of the multiple primary color display device is represented with the solid line (RGBYe). In FIG. 30, the white arrow shows the locus of the color displayed by the pixel when the gray scale level of the green signal is changed from the minimum level to the maximum level. In FIG. 30, the circle and the double circle respectively represent the green which ought to be displayed and the green which is actually displayed by the pixel, when the green signal having the maximum gray scale level is input.

When a green signal is input to the conventional multiple primary color display device, as shown in FIG. 28, the gray scale level of the green signal is the gray scale level of the green sub pixel G as it is. Namely, the luminances of the sub pixels other than the green sub pixel are zero regardless of the gray scale level of the green signal. At this point, as shown in FIG. 29, the luminance of the pixel which is actually output is significantly lower than the luminance which ought to be output. A reason for this is that when the number of primary colors used for display is increased, the number of sub pixels per pixel is increased and thus the area size of each sub pixel is necessarily decreased, and thus the area size of the green sub pixel G for displaying green is decreased. As a result, as shown in FIG. 30, the lightness of the green displayed by the pixel is lower than the lightness of the green of the sRGB color space.

As described above, in the conventional multiple primary color display device, when the green signal is input, display is provided by use of only the green sub pixel G. Therefore, the luminance (lightness) of the green actually displayed by the pixel is significantly decreased.

The liquid crystal display device 100 in this embodiment provides display by use of a sub pixel(s) other than the green sub pixel G in addition to the green sub pixel G when a green signal (input signal corresponding to the green of the sRGB color space) is externally input. Specifically, in the liquid crystal display device 100, when a green signal is input, display is provided by use of the yellow sub pixel Ye in addition to the green sub pixel G. When necessary, the blue sub pixel B is also used for display. Accordingly, in the liquid crystal display device 100 in this embodiment, the sub pixel(s) other than the green sub pixel G, as well as the green sub pixel G, contributes to the display provided when the green signal is input. Therefore, the decrease of the luminance can be suppressed and decline of the display quality can be suppressed.

Hereinafter, specific examples of the manner of display when a green signal is input to the liquid crystal display device 100 will be described.

EXAMPLE 1

Table 1 shows chromaticities x and y and the luminance ratio of each of the primary colors displayed by the red sub pixel R, the green sub pixel G, the blue sub pixel B and the yellow sub pixel Ye in this example. The values of the chromaticities x and y and the luminance ratio of each primary color shown in Table 1 are the same in the following examples.

TABLE 1

| | Luminance ratio | x | y |
|---|---|---|---|
| R | 14.6% | 0.645 | 0.327 |
| Ye | 40.4% | 0.431 | 0.559 |
| G | 33.1% | 0.255 | 0.620 |
| B | 11.9% | 0.148 | 0.054 |

Figure 3:
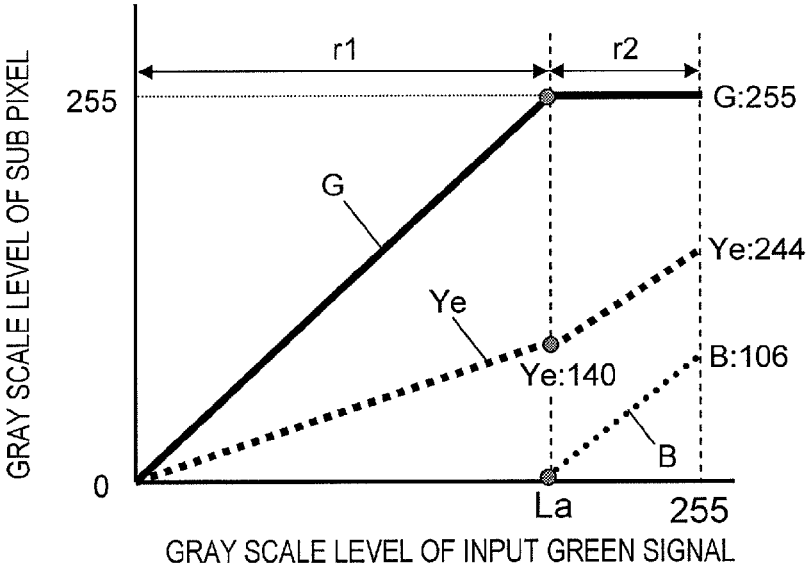
FIG. 3 is a graph showing the relationship between the gray scale level of an input green signal (input gray scale level) and the gray scale level of each sub pixel (output gray scale level) in Example 1.

FIG. 3 shows the relationship between the gray scale level of an input green signal (input gray scale level) and the gray scale level of each sub pixel (output gray scale level) in this example. In the example shown in FIG. 3, in a first range r1 of the gray scale level of the green signal from the minimum level (zero) to a prescribed intermediate level (La), display is provided by use of the green sub pixel G and the yellow sub pixel Ye. In a second range r2 from the intermediate level (La) to the maximum level (255), display is provided by use of the green sub pixel G, the yellow sub pixel Ye and also the blue sub pixel B.

As shown in FIG. 3, the ratios of increase of the gray scale levels of the green sub pixel G and the yellow sub pixel Ye with respect to the increase of the gray scale level of the green signal (corresponding to the gradient of the straight lines shown in FIG. 3; hereinafter, referred to as the "output increase ratios") are different between in the first range r1 and in the second range r2.

The output increase ratio of the green sub pixel G is lower in the first range r2 than in the first range r1, and more specifically, is zero. Namely, the gray scale level of the green sub pixel G increases as the gray scale level of the green signal increases, and reaches the maximum level (255) when the gray scale level of the green signal is the intermediate level La. After that, the gray scale level of the green sub pixel G is kept the same. By contrast, the output increase ratio of the yellow sub pixel Ye is higher in the first range r2 than in the first range r1.

When the gray scale level of the green signal is the intermediate level La (here, 206), the gray scale level of the yellow sub pixel Ye is, for example, 140. When the gray scale level of the green signal is the maximum level, the gray scale levels of the blue sub pixel B and the yellow sub pixel Ye are, for example, respectively 106 and 244.

Figure 4:
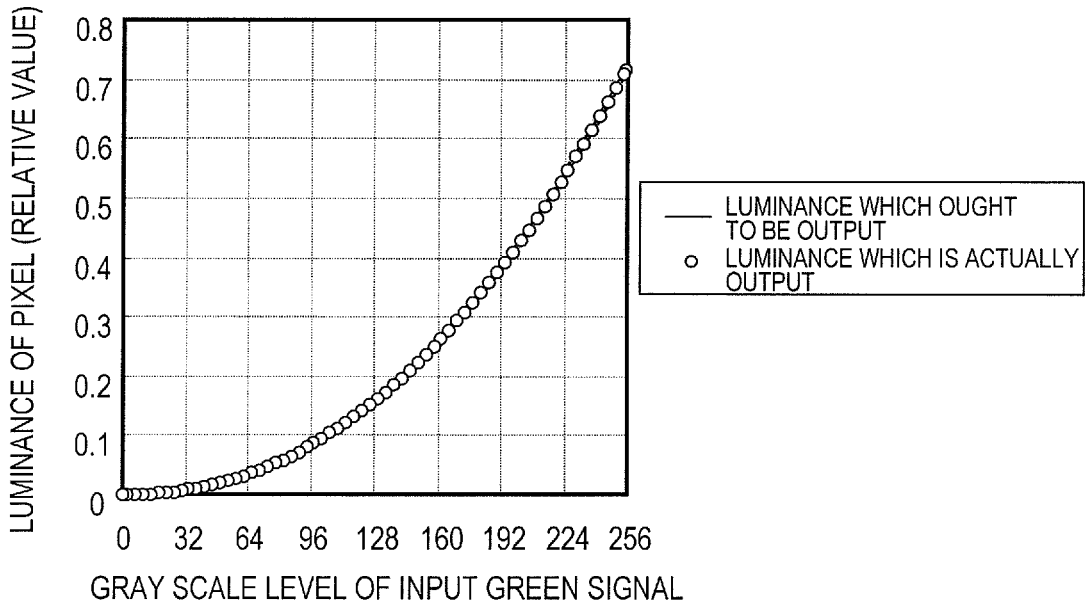
FIG. 4 is a graph showing the relationship between the gray scale level of the green signal and the luminance (relative value) of the pixel in Example 1.
Figure 5:
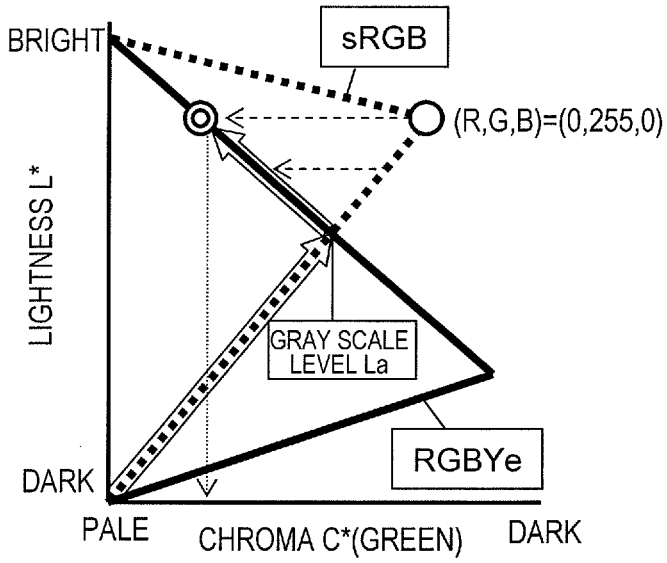
FIG. 5 is a graph showing the C*-L* characteristic (relationship between the chroma and the lightness at the hue corresponding to the green of the sRGB color space) of the color displayed by the pixel in Example 1.

FIG. 4 shows the relationship between the gray scale level of the green signal and the luminance (relative value) of the pixel, and FIG. 5 shows the C*-L* characteristic (relationship between the chroma and the lightness at the hue corresponding to the green of the sRGB color space) of the color displayed by the pixel, when display is provided as in the example shown in FIG. 3.

As shown in FIG. 4, the luminance which is actually output substantially matches the luminance which ought to be output. Therefore, as shown in FIG. 5, the lightness of the color displayed by the pixel substantially matches the lightness of the green of the sRGB color space. The locus of the color displayed by the pixel is shown in one color tone diagram (FIG. 5). As can be seen from this, the hue of the color displayed by the pixel substantially matches the hue of the green of the sRGB color space. Also as can be seen from FIG. 5, in the range of the gray scale level of the green signal from the minimum level to the intermediate level La (i.e., in the first range r1), the chroma of the color displayed by the pixel substantially matches the chroma of the green of the sRGB color space.

Accordingly, when display is provided as in this example, in the first range r1, the hue, chroma and lightness of green corresponding to the green signal (i.e., green which ought to be displayed) substantially match the hue, chroma and lightness of the color which is actually displayed by the pixel. In the second range r2, the hue and lightness of the green corresponding to the green signal substantially match the hue and lightness of the color which is actually displayed by the pixel. Namely, in the first range r1, all of the hue, chroma and lightness can be output with fidelity; and in the second range r2, the hue and lightness can be output with fidelity. Therefore, decline of the display quality when the input signal corresponding to the green of the sRGB color space is externally input is suppressed.

Figure 6:
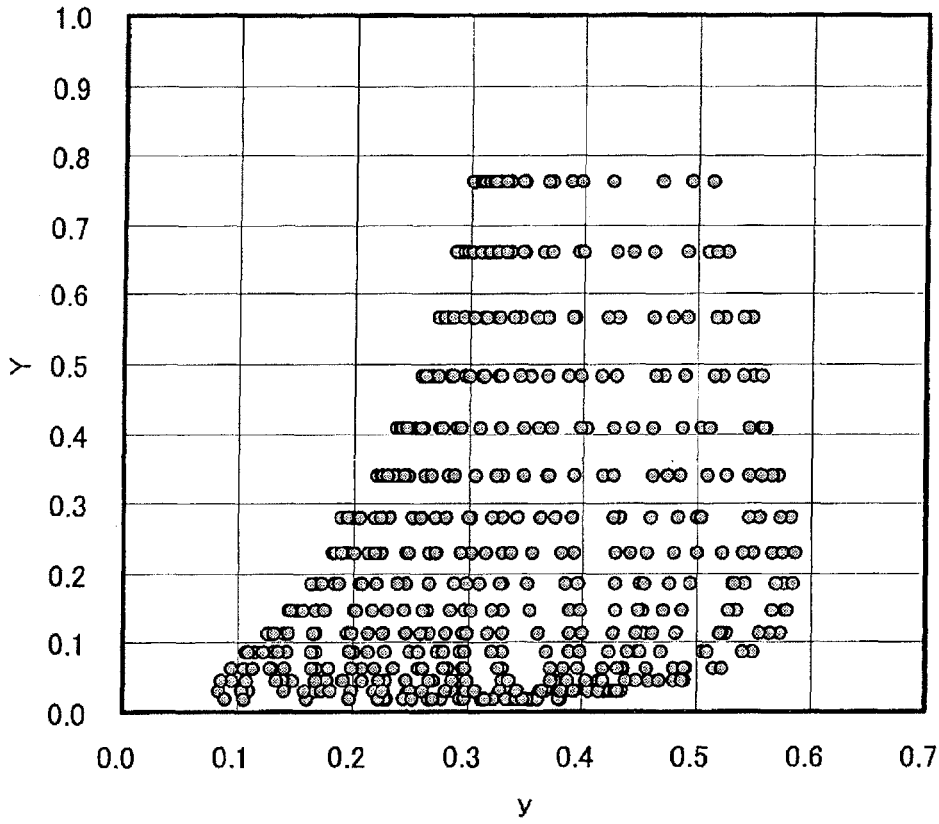
FIG. 6 is a graph in which the object colors (i.e., existing colors) of Pointer are plotted, with the horizontal axis representing the y coordinate in the XYZ colorimetric system and the vertical axis representing the Y value in the XYZ colorimetric system.

It is preferable that the intermediate level La, which is the end of the first range r1 (range in which all of the hue, chroma and lightness can be reproduced with fidelity) is a level at which, when the Y value of white displayed by the pixel in the XYZ colorimetric system is 1, the Y value of the green to be displayed (green corresponding to the green signal) is 0.3 or greater. FIG. 6 is a graph in which the object colors (i.e., existing colors) of Pointer are plotted, with the horizontal axis representing the y coordinate in the XYZ colorimetric system and the vertical axis representing the Y value in the XYZ colorimetric system. As shown in FIG. 6, in the range of $Y \leq 0.3$, there are existing colors at or around the green of the sRGB color space (y=about 0.6). This shows that a signal corresponding to any such color is possibly input. By setting the intermediate level La to a level at which $Y \geq 0.3$, the existing colors at or around the green of the sRGB color space can be reproduced with fidelity.

As described above, in this example, in the first range r1, the hue, chroma and lightness of the green corresponding to the green signal substantially match the hue, chroma and lightness of the color which is actually displayed by the pixel. Namely, the green corresponding to the green signal substantially matches the green which is actually displayed by the pixel. In this specification, when it is expressed that colors "substantially match each other", it means that the color difference ΔE*ab in an L*a*b* colorimetric system is 5 or less. The color difference ΔE*ab is defined by ΔL*, Δa* and Δb*, which are differences of the coordinates L*, a* and b* in the L*a*b* colorimetric system. Specifically, ΔE*ab is expressed as $\Delta E^*ab=[(\Delta L^*)^2+(\Delta a^*)^2+(\Delta b^*)^2]^{1/2}$. ΔE*ab=5 is such a color difference that is found only when two colors are arranged side by side.

The gray scale level of the yellow sub pixel Ye when the gray scale level of the green signal is the intermediate level La is not limited to the value shown in FIG. 3 as an example (140). The gray scale levels of the blue sub pixel B and the yellow sub pixel Ye when the gray scale level of the green signal is the maximum level are not limited to the values shown in FIG. 3 as examples (106, 244).

EXAMPLE 2

Figure 7:
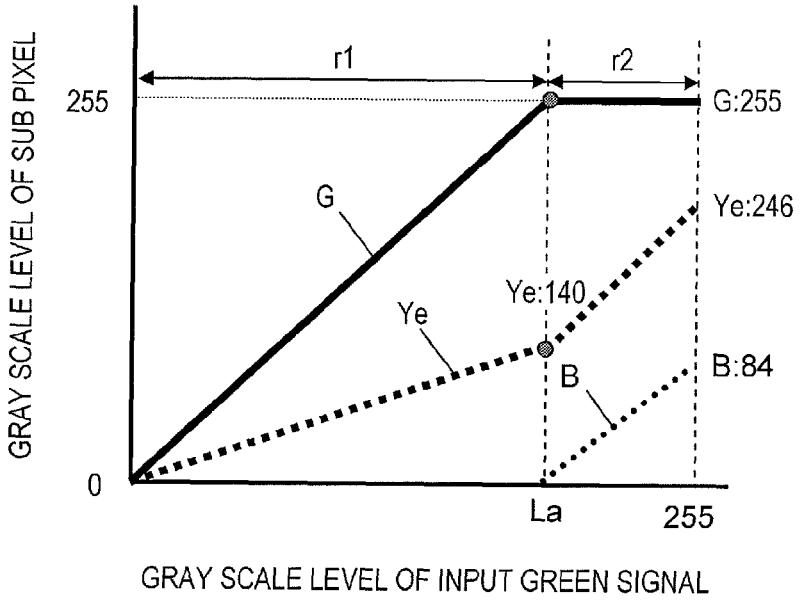
FIG. 7 is a graph showing the relationship between the gray scale level of an input green signal (input gray scale level) and the gray scale level of each sub pixel (output gray scale level) in Example 2.

FIG. 7 shows the relationship between the gray scale level of an input green signal (input gray scale level) and the gray scale level of each sub pixel (output gray scale level) in this example. In the example shown in FIG. 7, like in the example shown in FIG. 3, in the first range r1 of the gray scale level of the green signal, display is provided by use of the green sub pixel G and the yellow sub pixel Ye; and in the second range r2, display is provided by use of the green sub pixel G, the yellow sub pixel Ye and also the blue sub pixel B.

However, in the example shown in FIG. 7, when the gray scale level of the green signal is the maximum level, the gray scale levels of the blue sub pixel B and the yellow sub pixel Ye are respectively 84 and 246 and are different from the values in the example shown in FIG. 3 (106, 244).

When display is provided as in the example shown in FIG. 7 also, the luminance which is actually output substantially matches the luminance which ought to be output. Therefore, the lightness of the color displayed by the pixel substantially matches the lightness of the green of the sRGB color space. In the example shown in FIG. 3, in the second range r2, the chroma of the color displayed by the pixel is significantly decreased as compared with the chroma of the green of the sRGB color space (see FIG. 5). However, in the example shown in FIG. 7, the chroma can be maintained to a certain degree also in the second range r2.

Figure 8:
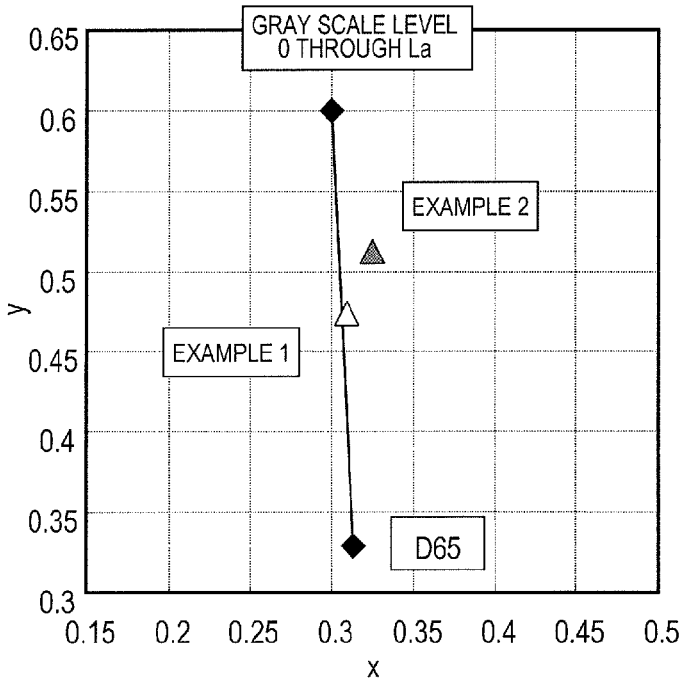
FIG. 8 is a graph showing chromaticities x and y of the color displayed by the pixel when the green signal of the maximum level is input in Example 1 and Example 2.

FIG. 8 shows the chromaticities x and y of the colors displayed by the pixel when the green signal of the maximum level is input in the example shown in FIG. 3 (Example 1) and the example shown in FIG. 7 (Example 2). FIG. 8 also shows the chromaticity of the color displayed by the pixel when the green signal in the first range r1 (gray scale level 0 through La) is input (same both in Example 1 and Example 2) and the chromaticity of white light provided by the D65 light source (standard light source having substantially the same color temperature as that of the sunlight).

As shown in FIG. 8, in Example 1, the chromaticity when the green signal of the maximum level is input is positioned between the chromaticity when the green signal of the gray scale level of 0 through La is input and the chromaticity provided by the D65 light source. Namely, the chromaticity when the green signal of the maximum level is input is shifted toward white color from the chromaticity when the green signal of the gray scale level of 0 through La is input. This means that the chroma is decreased. By contrast, in Example 2, the amount of shift of the chromaticity when the green signal of the maximum level is input from the chromaticity when the green signal of the gray scale level of 0 through La is input is smaller than that in Example 1. This means that the decrease of the chroma is suppressed.

As can be seen, in Example 2, the decrease of the chroma in the second range r2 can be suppressed more than in Example 1. However, in Example 2, the chromaticity when the green signal of the maximum level is input is offset from the straight line connecting the chromaticity when the green signal of the gray scale level of 0 through La is input and the chromaticity provided by the D65 light source. This means that the hue is shifted. Namely, in Example 2, the chroma can be maintained to a certain degree, but the hue is shifted. By contrast, in Example 1, the chromaticity when the green signal of the maximum level is input is on the straight line connecting the chromaticity when the green signal of the gray scale level of 0 through La is input and the chromaticity provided by the D65 light source. As can be seen from this, the hue is not shifted. Accordingly, in the second range r2, when the hue is more important, it is preferable to provide display as in Example 1; whereas when the chroma is important, it is preferable to provide display as in Example 2.

The gray scale level of the yellow sub pixel Ye when the gray scale level of the green signal is the intermediate level La (here, 206) is not limited to the value shown in FIG. 7 as an example (140). The gray scale levels of the yellow sub pixel Ye and the blue sub pixel B when the gray scale level of the green signal is the maximum level are not limited to the values shown in FIG. 7 as examples (246, 84).

Figure 9:
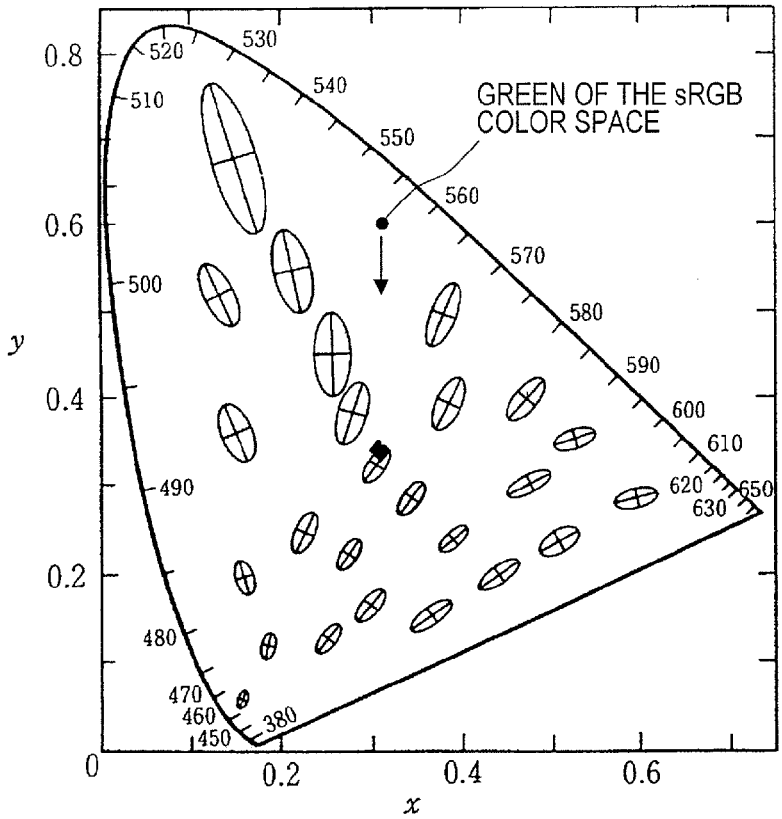
FIG. 9 is an xy chromaticity diagram showing the MacAdam ellipse.

As can be seen from the above, in the second range r2, as the gray scale level of the green signal is increased, the chroma is decreased toward the white color. Preferably, the direction of shift in this case is the direction of the longer axis of the MacAdam ellipse. FIG. 9 shows the MacAdam ellipse in the xy chromaticity diagram. The MacAdam ellipse shows regions which appear to be the same color in the xy chromaticity diagram. It should be noted that in FIG. 9, the MacAdam ellipse is magnified to be 10 times as large as the actual size. Where the direction of shift of the chromaticity is the direction of the longer axis of the MacAdam ellipse (direction of the arrow shown in FIG. 9), the decrease of the chroma is not easily recognized visually as a color difference.

Figure 10:
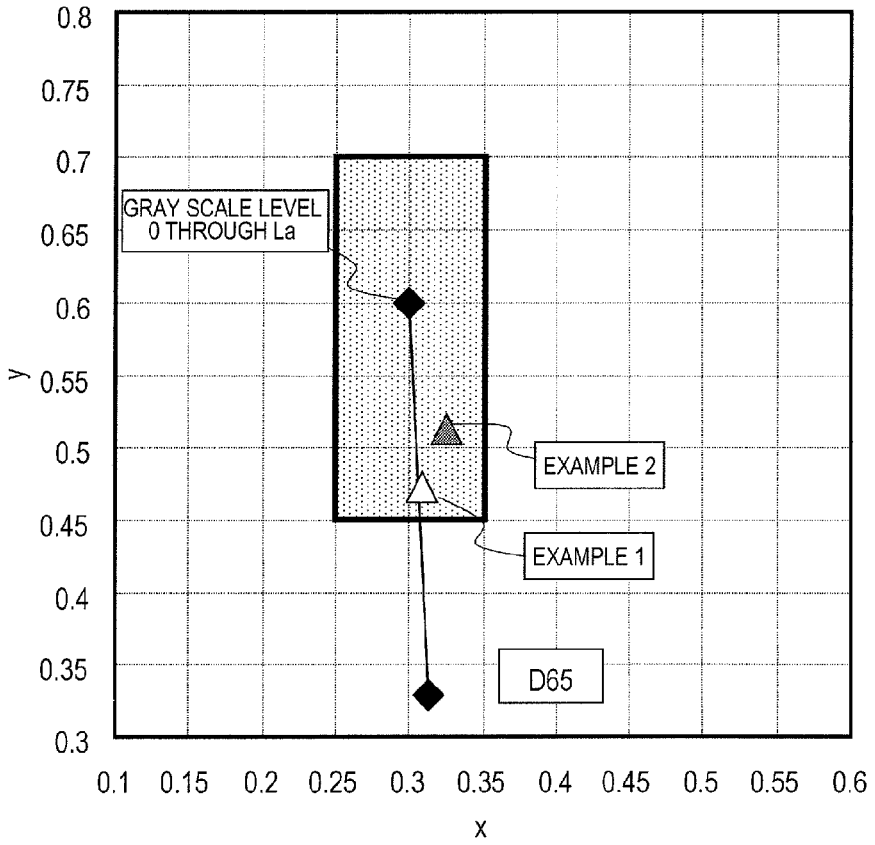
FIG. 10 is a graph showing chromaticities x and y of the color displayed by the pixel when the green signal of the maximum level is input in Example 1 and Example 2.

FIG. 10 shows the chromaticities x and y of the colors displayed by the pixel when the green signal of the maximum level (255) is input in Example 1 and Example 2. From the viewpoint of ensuring that decline of the display quality at a high gray scale level (caused by the shift between the green which ought to be displayed and the green which is actually displayed) is suppressed, it is preferable that the chromaticities x and y when the green signal of the maximum level is input are in the ranges of $0.25 \leq x \leq 0.35$ and $0.45 \leq y \leq 0.70$ as shown in FIG. 10. It is preferable that the Y value when the green signal of the maximum level is input is in the range of $0.3 \leq Y \leq 0.8$ where the Y value of white displayed by the pixel is 1. Accordingly, it is preferable that the chromaticities x and y and the Y value, in the XYZ colorimetric system, of the color displayed by the pixel when the gray scale level of the green signal is the maximum level fulfill the relationships of $0.25 \leq x \leq 0.35$, $0.45 \leq y \leq 0.70$ and $0.3 \leq Y$ 0.8. This is also applicable to the following examples as well as Example 1 and Example 2.

EXAMPLE 3

Figure 11:
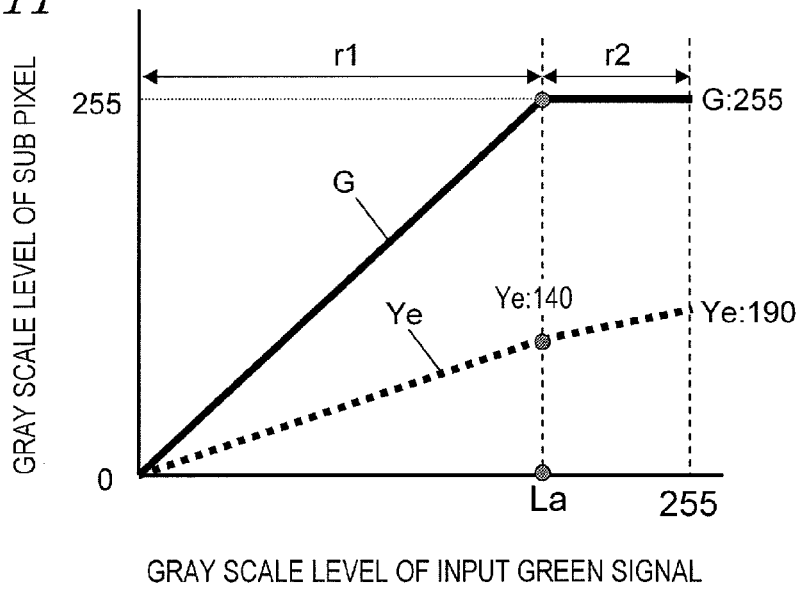
FIG. 11 is a graph showing the relationship between the gray scale level of an input green signal (input gray scale level) and the gray scale level of each sub pixel (output gray scale level) in Example 3.

FIG. 11 shows the relationship between the gray scale level of an input green signal (input gray scale level) and the gray scale level of each sub pixel (output gray scale level) in this example. Unlike the example shown in FIG. 3 or the example shown in FIG. 7, the example shown in FIG. 11 does not use the blue sub pixel B for display in the second range r2. Namely, in the example shown in FIG. 11, both in the first range r1 and the second range r2, display is provided by use of only the green sub pixel G and the yellow sub pixel Ye.

As shown in FIG. 11, the output increase ratios of the green sub pixel G and the yellow sub pixel Ye are different between in the first range r1 and in the second range r2.

The output increase ratio of the green sub pixel G is lower in the second range r2 than in the first range r1, and more specifically, is zero. Namely, the gray scale level of the green sub pixel G increases as the gray scale level of the green signal increases, and reaches the maximum level (255) when the gray scale level of the green signal is the intermediate level La. After that, the gray scale level of the green sub pixel G is kept the same.

The output increase ratio of the yellow sub pixel Ye is lower in the second range r2 than in the first range r1, but is not zero. When the gray scale level of the green signal is the intermediate level La (here, 206), the gray scale level of the yellow sub pixel Ye is, for example, 140. When the gray scale level of the green signal is the maximum level, the gray scale level of the yellow sub pixel Ye is, for example, 190.

Figure 12:
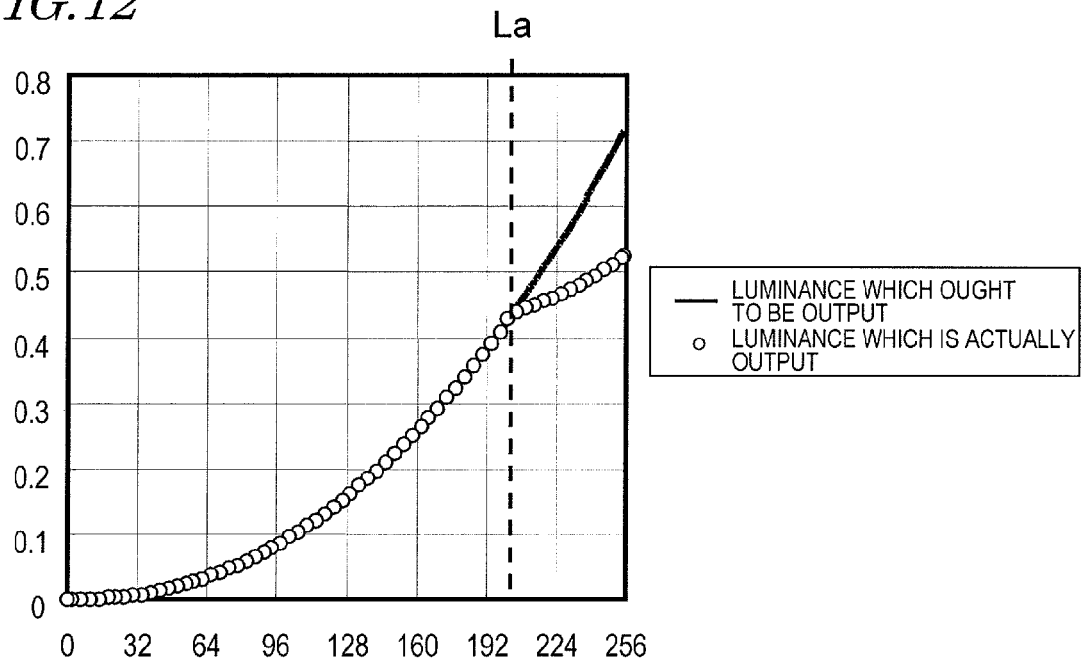
FIG. 12 is a graph showing the relationship between the gray scale level of the green signal and the luminance (relative value) of the pixel in Example 3.
Figure 13:
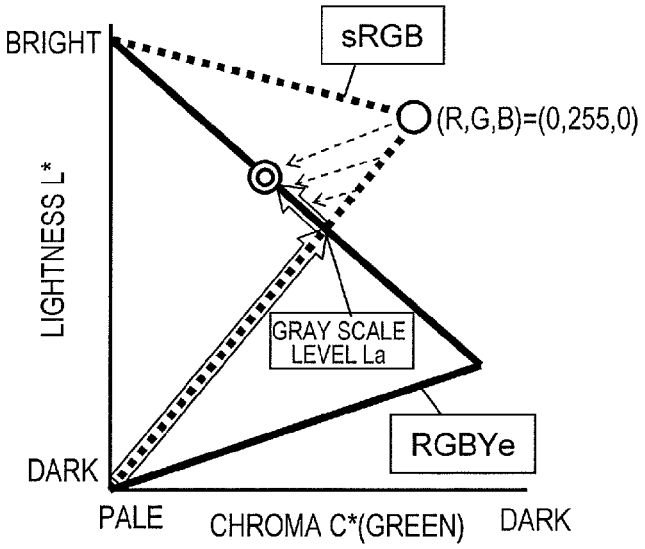
FIG. 13 is a graph showing the C*-L* characteristic (relationship between the chroma and the lightness at the hue corresponding to the green of the sRGB color space) of the color displayed by the pixel in Example 3.

FIG. 12 shows the relationship between the gray scale level of the green signal and the luminance (relative value) of the pixel, and FIG. 13 shows the C*-L* characteristic (relationship between the chroma and the lightness at the hue corresponding to the green of the sRGB color space) of the color displayed by the pixel, when display is provided as in the example shown in FIG. 11.

As shown in FIG. 12, in the range of the gray scale level of the green signal from the minimum level (0) to the intermediate level La (here, 206), the luminance which is actually output substantially matches the luminance which ought to be output. By contrast, in the range of the gray scale level of the green signal from the intermediate level La to the maximum level (255), the luminance which is actually output is lower than the luminance which ought to be output. Therefore, as shown in FIG. 13, the lightness of the color displayed by the pixel substantially matches the lightness of the green of the sRGB color space in the first range r1 and is lower than the lightness of the green of the sRGB color space in the second range r2.

As can be seen from FIG. 13, in the first range r1, the chroma of the color displayed by the pixel substantially matches the chroma of the green of the sRGB color space. In the second range r2, the luminance output from the green sub pixel G is constant, whereas the luminance output from the yellow sub pixel Ye is increased. As a result, the chroma of the color displayed by pixel becomes lower than the chroma of the green of the sRGB color space. Along with this, the hue of the color displayed to by the pixel is shifted toward yellow gradually. However, as can be seen from a comparison between FIG. 13 and FIG. 5, the decrease of the chroma in the second range r2 is smaller in this example than in Example 1.

Figure 14:
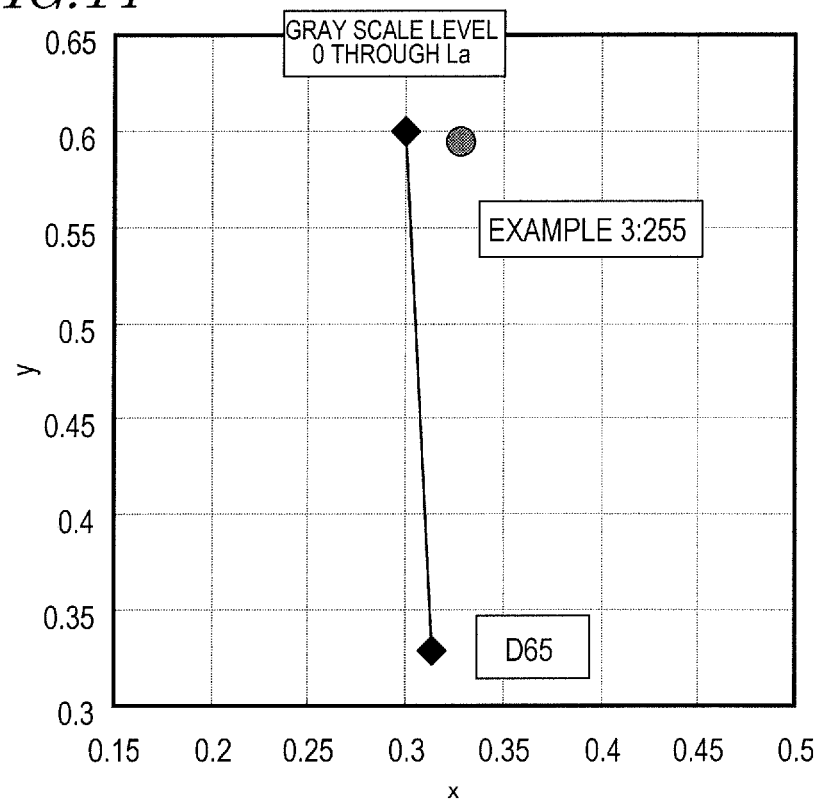
FIG. 14 is a graph showing chromaticities x and y of the color displayed by the pixel when the green signal of the maximum level is input in Example 3.

FIG. 14 shows the chromaticities x and y of the color displayed by the pixel when the green signal of the maximum level (255) is input in the example shown in FIG. 11 (Example 3). FIG. 14 also shows the chromaticity of the color displayed by the pixel when a green signal in the first range r1 (gray scale level 0 through La) is input and the chromaticity of white light provided by the D65 light source.

As shown in FIG. 14, the chromaticity when the green signal of the maximum level is input is positioned right with respect to a position between the chromaticity when the green signal of the gray scale level of 0 through La is input and the chromaticity provided by the D65 light source, and is shifted toward yellow from the chromaticity when the green signal of the gray scale level of 0 through La is input. However, as can be seen from a comparison between FIG. 14 and FIG. 8, the amount of shift is smaller than that in Example 1, which means that the decrease of the chroma is suppressed. The shift of the hue is not very large.

As described above, when display is provided as in this example, in the second range r2, the lightness is slightly decreased but the decrease of the chroma can be suppressed and the shift of the hue can also be suppressed. Namely, in this example, in the first range r1, all of the hue, chroma and lightness can be output with fidelity; and in the second range r2, the chroma, hue and lightness can be maintained to a certain degree.

In the example shown in FIG. 11, the output increase ratio of the yellow sub pixel Ye is lower in the second range r2 than in the first range r1. Alternatively, the output increase ratio of the yellow sub pixel Ye may be higher in the second range r2 than in the first range r1.

The gray scale level of the yellow sub pixel Ye when the gray scale level of the green signal is the intermediate level La is not limited to the value shown in FIG. 11 as an example (140). The gray scale level of the yellow sub pixel Ye when the gray scale level of the green signal is the maximum level is not limited to the value shown in FIG. 11 as an example (190).

EXAMPLE 4

Figure 15:
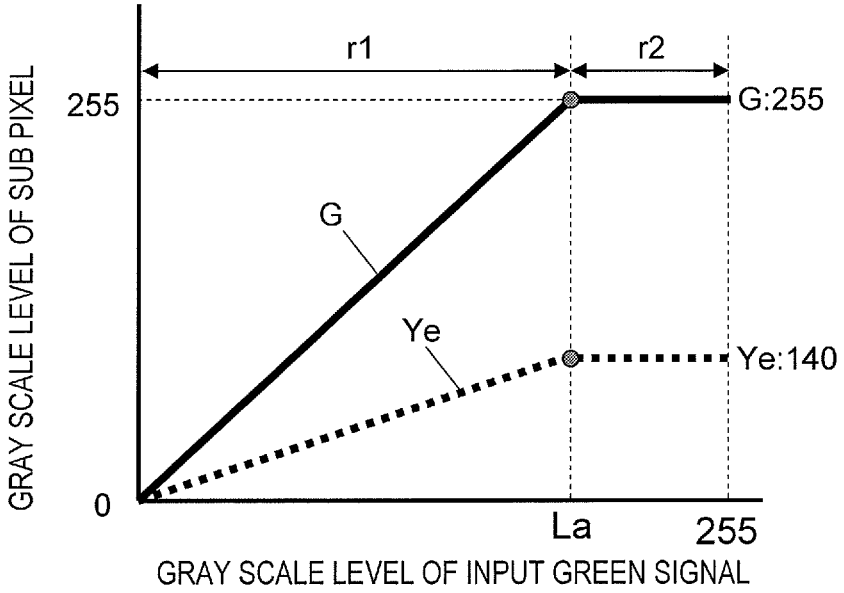
FIG. 15 is a graph showing the relationship between the gray scale level of an input green signal (input gray scale level) and the gray scale level of each sub pixel (output gray scale level) in Example 4.

FIG. 15 shows the relationship between the gray scale level of an input green signal (input gray scale level) and the gray scale level of each sub pixel (output gray scale level) in this example. In the example shown in FIG. 15, display is provided by use of the green sub pixel G and the yellow sub pixel Ye in both of the first range r1 and the second range r2.

As shown in FIG. 15, the output increase ratios of the green sub pixel G and the yellow sub pixel Ye are different between in the first range r1 and in the second range r2.

The output increase ratio of the green sub pixel G is lower in the second range r2 than in the first range r1, and more specifically, is zero. The gray scale level of the green sub pixel G increases as the gray scale level of the green signal increases, and reaches the maximum level (255) when the gray scale level of the green signal is the intermediate level La. After that, the gray scale level of the green sub pixel G is kept the same.

The output increase ratio of the yellow sub pixel Ye is also lower in the second range r2 than in the first range r1, and more specifically, is zero. The gray scale level of the yellow sub pixel Ye increases as the gray scale level of the green signal increases, and reaches a certain level (e.g., 140) when the gray scale level of the green signal is the intermediate level La. After that, the gray scale level of the yellow sub pixel Ye is kept the same.

In the example shown in FIG. 15, in the second range r2, the output increase ratios of the green sub pixel G and the yellow sub pixel Ye are zero. Therefore, the color displayed by the pixel is kept the same in the second range r2. Namely, in the second range r2, the hue, chroma and lightness of the color displayed by the pixel are constant.

Figure 16:
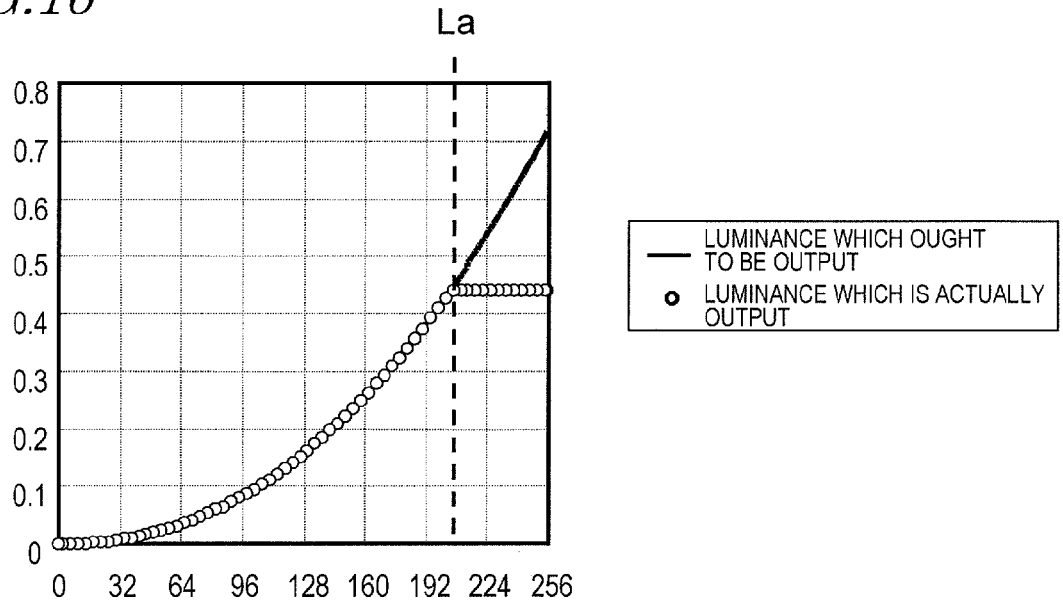
FIG. 16 is a graph showing the relationship between the gray scale level of the green signal and the luminance (relative value) of the pixel in Example 4.
Figure 17:
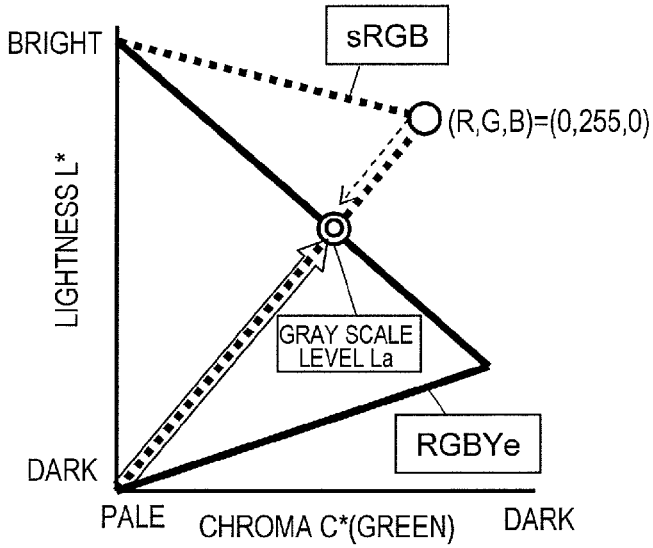
FIG. 17 is a graph showing the C*-L* characteristic (relationship between the chroma and the lightness at the hue corresponding to the green of the sRGB color space) of the color displayed by the pixel in Example 4.

FIG. 16 shows the relationship between the gray scale level of the green signal and the luminance (relative value) of the pixel, and FIG. 17 shows the C*-L* characteristic (relationship between the chroma and the lightness at the hue corresponding to the green of the sRGB color space) of the color displayed by the pixel, when display is provided as in the example shown in FIG. 15.

As shown in FIG. 16, in the range of the gray scale level of the green signal from the minimum level (0) to the intermediate level La (here, 206), the luminance which is actually output substantially matches the luminance which ought to be output. By contrast, in the range of the gray scale level of the green signal from the intermediate level La to the maximum level (255), the luminance which is actually output is constant. Therefore, as shown in FIG. 17, the lightness of the color displayed by the pixel substantially matches the lightness of the green of the sRGB color space in the first range r1 and is constant in the second range r2.

As can be seen from FIG. 17, the chroma of the color displayed by the pixel substantially matches the chroma of the green of the sRGB color space in the first range r1, and is constant in the second range r2. The locus of the color displayed by the pixel is shown in one color tone diagram (FIG. 17). As can be seen from this, the hue of the color displayed by the pixel substantially matches the hue of the green of the sRGB color space (namely, is constant both in the first range r1 and the second range r2).

Figure 18:
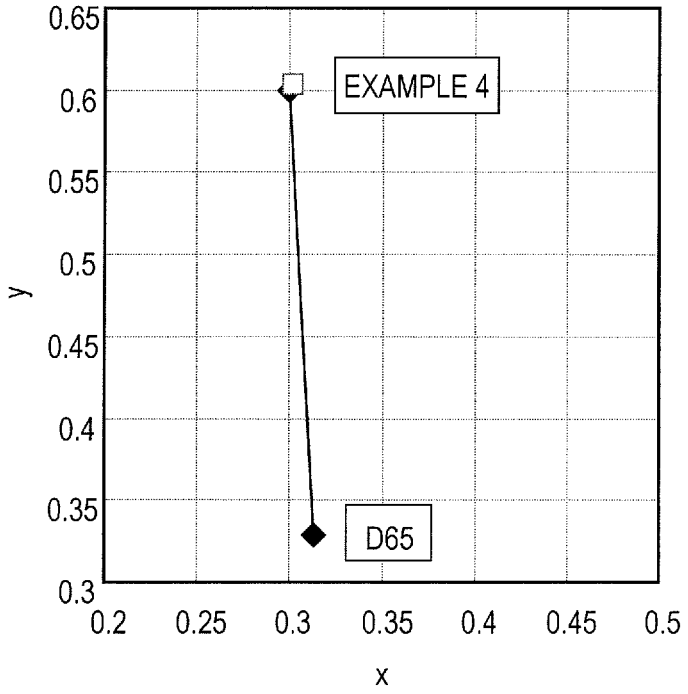
FIG. 18 is a graph showing chromaticities x and y of the color displayed by the pixel when the green signal is input in Example 4.

FIG. 18 shows the chromaticities x and y of the color displayed by the pixel when the green signal is input in the example shown in FIG. 15 (Example 4). FIG. 18 also shows the chromaticity of white light provided by the D65 light source. As shown in FIG. 18, the chromaticity when the green signal is input is the same at all the gray scale levels of the green signal.

As described above, when display is provided as in this example, the hue, chroma and lightness are constant in the second range r2. Therefore, a display color having chromaticity coordinates substantially matching those of the green of the sRGB color space is always output in the first range r1 and also in the second range r2. Namely, in the second range r2, the lightness is decreased as compared with the lightness which ought to be output but green having substantially the same hue as that of the green of the sRGB color space can be displayed with the highest possible chroma which can be realized by the multiple primary color liquid crystal display device 100.

The gray scale level of the yellow sub pixel Ye when the gray scale level of the green signal is in the second range r2 is not limited to the value shown in FIG. 15 as an example (140).

EXAMPLE 5

Figure 19:
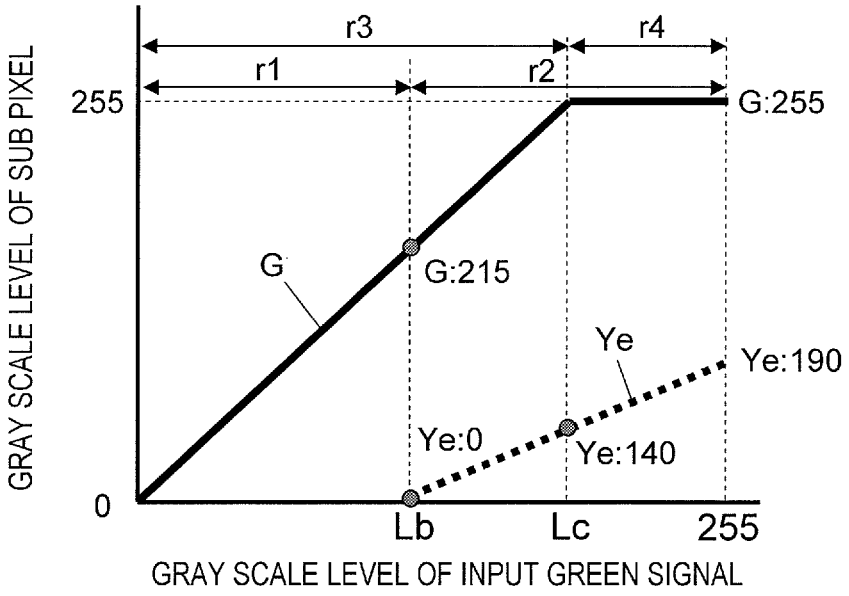
FIG. 19 is a graph showing the relationship between the gray scale level of an input green signal (input gray scale level) and the gray scale level of each sub pixel (output gray scale level) in Example 5.

FIG. 19 shows the relationship between the gray scale level of an input green signal (input gray scale level) and the gray scale level of each sub pixel (output gray scale level) in this example. In the example shown in FIG. 19, in a first range r1 of the gray scale level of the green signal from the minimum level (i.e., zero) to a prescribed intermediate level Lb, display is provided by use of only the green sub pixel G. By contrast, in a second range r2 from the intermediate level Lb to the maximum level (i.e., 255), display is provided by use of the green sub pixel G and the yellow sub pixel Ye.

Where the intermediate level Lb is a first intermediate level, as shown in FIG. 19, the output increase ratio of the yellow sub pixel Ye is different between in the first range r1 of the gray scale level of the green signal from the minimum level to the first intermediate level Lb and in the second range r2 from the first intermediate level Lb to the maximum level. The output increase ratio of the green sub pixel G is different between in a third range r3 of the gray scale level of the green signal from the minimum level to a second intermediate level Lc and in a fourth range r4 from the second intermediate level Lc to the maximum level. The second intermediate level Lc is higher than the first intermediate level Lb.

The output increase ratio of the yellow sub pixel Ye is lower in the first range r1 than in the second range r2, and is zero. Therefore, when the gray scale level of the green signal is the first intermediate level Lb, the gray scale level of the yellow sub pixel Ye is 0. When the gray scale level of the green signal is the second intermediate level Lc, the gray scale level of the yellow sub pixel Ye is, for example, 140. When the gray scale level of the green signal is the maximum level, the gray scale level of the yellow sub pixel Ye is, for example, 190.

The output increase ratio of the green sub pixel G is lower in the fourth range r4 than in the third range r3, and more specifically, is zero. Namely, the gray scale level of the green sub pixel G increases as the gray scale level of the green signal increases, and reaches the maximum level (i.e., 255) when the gray scale level of the green signal is the second intermediate level Lc. After that, the gray scale level of the green sub pixel G is kept the same. When the gray scale level of the green signal is the first intermediate level Lb, the gray scale level of the green sub pixel G is, for example, 215.

Figure 20:
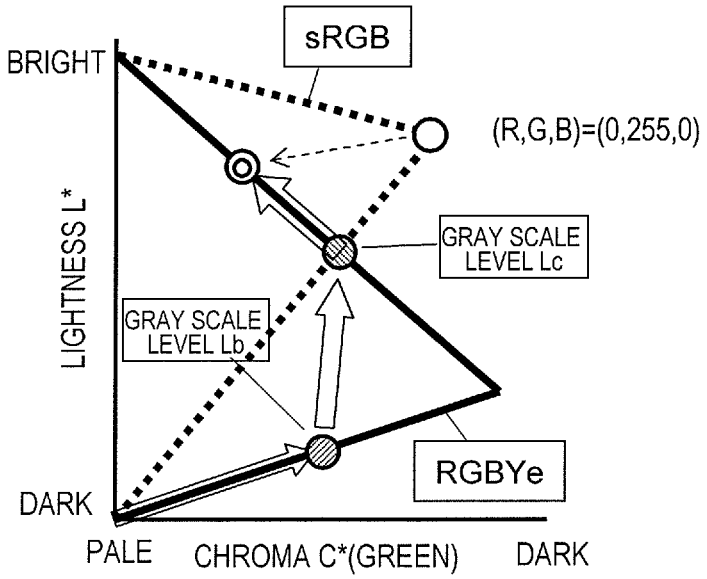
FIG. 20 is a graph showing the C*-L* characteristic (relationship between the chroma and the lightness at the hue corresponding to the green of the sRGB color space) of the color displayed by the pixel in Example 5.

As can be seen, in this example, the input gray scale level at which the output increase ratio changes is different between for the green sub pixel G and for the yellow sub pixel Ye. FIG. 20 shows the C*-L* characteristic (relationship between the chroma and the lightness at the hue corresponding to the green of the sRGB color space) of the color displayed by the pixel when display is provided as in the example shown in FIG. 19.

As shown in FIG. 20, in the first range r1, the locus of the color displayed by the pixel is along the outer perimeter of the color reproduction range of the multiple primary color liquid crystal display device 100. Namely, in this example, unlike in Examples 1 through 4 described above, in the first range r1, neither the chroma nor the lightness of the green of the sRGB color space is output with fidelity.

When the yellow sub pixel Ye starts to be lit up (i.e., when the gray scale level of the yellow sub pixel Ye starts increasing) at the start of the second range r2 (first intermediate level Lb), the locus of the color displayed by the pixel becomes offset from the outer perimeter of the color reproduction range of the multiple primary color liquid crystal display device 100. When the gray scale level of the green signal is the intermediate level Lc, the gray scale level of the green sub pixel G is the maximum level (255). As a result, green having the highest chroma is displayed by the pixel. Even when the gray scale level of the green signal becomes higher than the second intermediate level Lc, the gray scale level of the green sub pixel G is not further increased. Therefore, the chroma of the green displayed by the pixel is gradually decreased. Accordingly, up to the first intermediate level Lb, the color displayed by the pixel is the same as the color displayed only by the green sub pixel G. Between the first intermediate level Lb and the second intermediate level Lc, the chroma of the color displayed by the pixel is higher than the chroma of the green of the sRGB color space. From the second intermediate level Lc to the end of the second range r2 (the maximum level), the chroma of the color displayed by the pixel is lower than the chroma of the green of the sRGB color space.

As can be seen from a comparison between FIG. 11 and FIG. 20, in this example, gray scale display is provided by use of a color range of green wider than in Example 3. Therefore, the gray scale display provided by the multiple primary color liquid crystal display device 100 shows natural transitions in the gray scale in any region from black via green to white and also smoothness.

It is preferable that the intermediate level Lb, which is the end of the first range r1 (range in which all of the hue, chroma and lightness can be reproduced with fidelity), is a gray scale level at which the Y value of the green to be displayed (green corresponding to the green signal) is 0.3 or greater for the same reason as that described above regarding the intermediate level La in Example 1.

The gray scale level of the green sub pixel G when the gray scale level of the green signal is the first intermediate level Lb is not limited to the value shown in FIG. 19 as an example (215). The gray scale level of the yellow sub pixel Ye when the gray scale level of the green signal is the second intermediate level Lc or the maximum level is not limited to the value shown in FIG. 19 as an example (140, 190).

EXAMPLE 6

Figure 21:
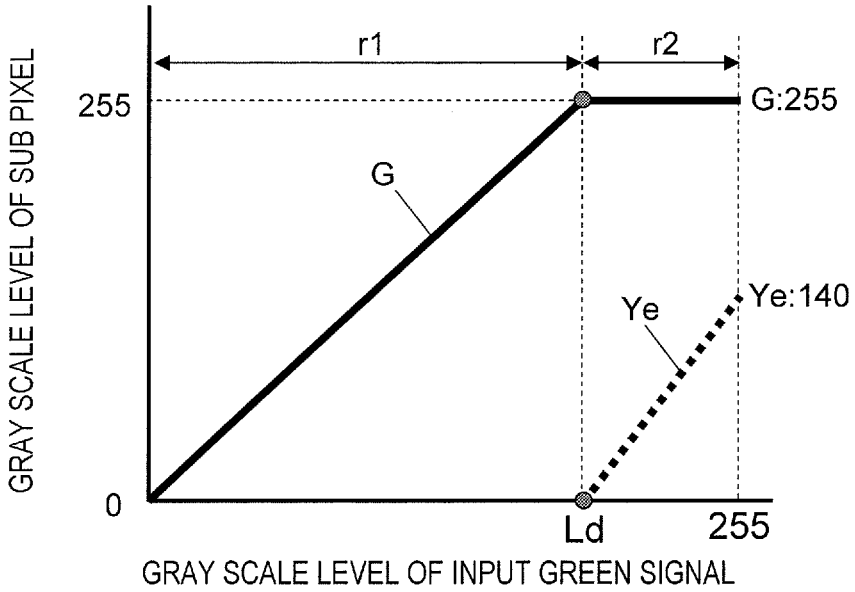
FIG. 21 is a graph showing the relationship between the gray scale level of an input green signal (input gray scale level) and the gray scale level of each sub pixel (output gray scale level) in Example 6.

FIG. 21 shows the relationship between the gray scale level of an input green signal (input gray scale level) and the gray scale level of each sub pixel (output gray scale level) in this example. In the example shown in FIG. 21, in a first range r1 of the gray scale level of the green signal from the minimum level (i.e., zero) to a prescribed intermediate level Ld, display is provided by use of only the green sub pixel G. By contrast, in a first range r2 from the intermediate level Ld to the maximum level (i.e., 255), display is provided by use of the green sub pixel G and also the yellow sub pixel Ye.

As shown in FIG. 21, the output increase ratio of the green sub pixel G is different between in the first range r1 and in the second range r2.

The output increase ratio of the green sub pixel G is lower in the second range r2 than in the first range r1, and more specifically, is zero. Namely, the gray scale level of the green sub pixel G increases as the gray scale level of the green signal increases, and reaches the maximum level (i.e., 255) when the gray scale level of the green signal is the intermediate level Ld. After that, the gray scale level of the green sub pixel G is kept the same.

When the gray scale level of the green signal is the maximum level, the gray scale level of the yellow sub pixel Ye is, for example, 140.

Figure 22:
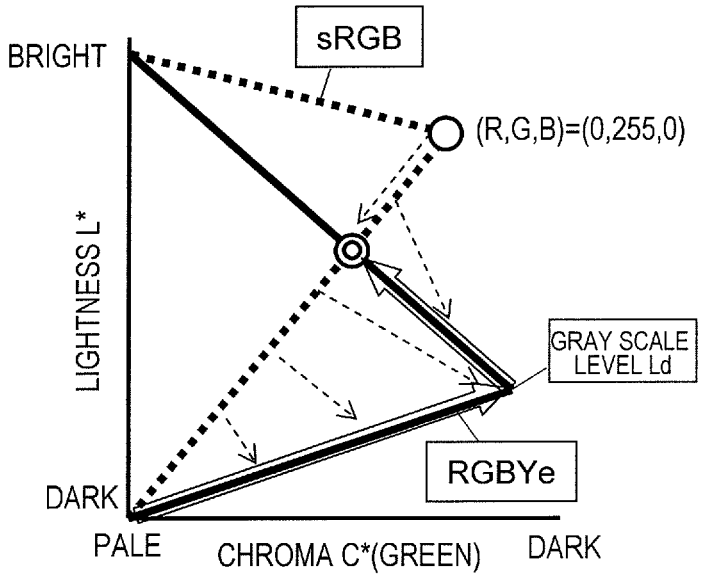
FIG. 22 is a graph showing the C*-L* characteristic (relationship between the chroma and the lightness at the hue corresponding to the green of the sRGB color space) of the color displayed by the pixel in Example 6.

FIG. 22 shows the C*-L* characteristic (relationship between the chroma and the lightness at the hue corresponding to the green of the sRGB color space) of the color displayed by the pixel when display is provided as in the example shown in FIG. 21.

As shown in FIG. 22, the locus of the color displayed by the pixel is along the outer perimeter of the color reproduction range of the multiple primary color liquid crystal display device 100. Namely, in this example, unlike in Examples 1 through 4 described above, in the first range r1, neither the chroma nor the lightness is output with fidelity. However, this example is different from the conventional example described above with reference to FIG. 28 through FIG. 30 on the following points.

In the conventional example, as shown in FIG. 28, the gray scale level of the green signal is the gray scale level of the green sub pixel G as it is. Therefore, as shown in FIG. 30, when the gray scale level of the green signal is the maximum level, green having the highest chroma (i.e., the darkest green) is displayed by the pixel.

By contrast, in this example, when the gray scale level of the green signal is the intermediate level Ld, the gray scale level of the green sub pixel G is the maximum level and green having the highest chroma is displayed by the pixel. When the gray scale level of the green signal becomes higher than the intermediate level Ld, the gray scale level of the yellow sub pixel Ye is increased. As a result, the lightness of the green displayed by the pixel is increased.

Therefore, as shown in FIG. 22, the locus of the color displayed by the pixel in this example includes green having a higher lightness as compared with the locus of the color displayed by the pixel in the conventional example (shown in FIG. 30). Accordingly, in this example, the lightness when the green signal is input is increased as compared with that in the conventional example. The locus of the color displayed by the pixel in this example is longer than the locus of the color displayed by the pixel in the conventional example. Therefore, in this example, natural transitions in the gray scale can be realized.

The gray scale level of the yellow sub pixel Ye when the gray scale level of the green signal is the maximum level is not limited to the value shown in FIG. 21 as an example (140).

It is preferable that the intermediate level Ld, which is the end of the first range r1 (input gray scale level at which the gray scale level of the green sub pixel G reaches the maximum level), is a gray scale level at which the Y value of the green to be displayed (green corresponding to the green signal) is 0.3 or greater for the same reason as that described above regarding the intermediate level La in Example 1.

(Specific Structures of the Signal Conversion Circuit)

Now, an example of specific structure of the signal conversion circuit 20 will be described.

The signal conversion circuit 20 has a lookup table including, for example, data which represents the luminance of a sub pixel corresponding to a color specified by a video signal (three-dimensional signal), and thus can generate a multiple primary color signal by referring to the lookup table in accordance with the input video signal. However, if the data representing the luminance of the sub pixel is included in the lookup table regarding all the colors, the data amount in the lookup table is excessively large. It is difficult to configure such a lookup table in a simple manner by use of a small-capacity low-cost memory.

Figure 23:
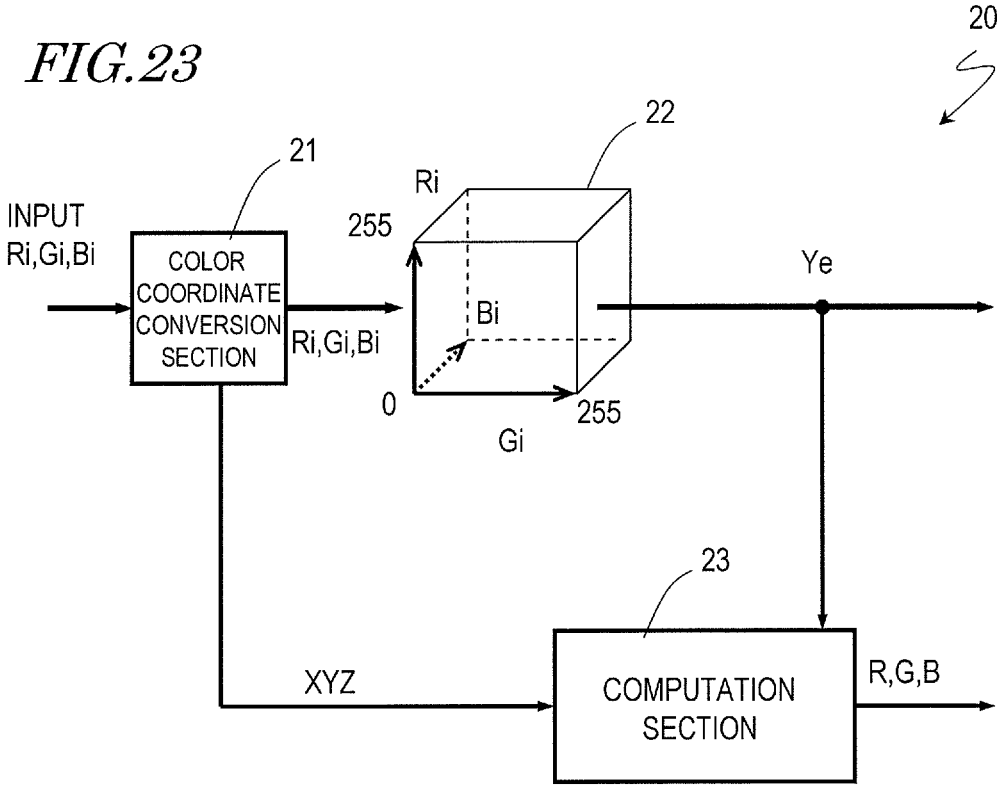
FIG. 23 is a block diagram showing an example of preferable structure of a signal conversion circuit included in the liquid crystal display device 100.

FIG. 23 shows an example of preferable structure of the signal conversion circuit 20. The signal conversion circuit 20 shown in FIG. 23 includes a color coordinate conversion section 21, a lookup table memory 22, and a computation section 23.

The color coordinate conversion section 21 receives a video signal representing the luminances of the three primary colors, and converts the color coordinates in an RGB color space into the color coordinates in an XYZ color space. Specifically, the color coordinate conversion section 21 performs matrix conversion on the RGB signal (including components Ri, Gi and Bi respectively corresponding to the luminances of red, green and blue) to obtain XYZ values as shown by the following expression (1). The 3 rows×3 columns matrix shown in expression (1) as an example is defined based on the BT. 709 standard.

[Expression 1]

$$\begin{pmatrix} X \\ Y \\ Z \end{pmatrix} = \begin{pmatrix} 0.4124 & 0.3576 & 0.1804 \\ 0.2127 & 0.7152 & 0.0722 \\ 0.0193 & 0.1192 & 0.9502 \end{pmatrix} \begin{pmatrix} Ri \\ Gi \\ Bi \end{pmatrix} \tag{1}$$

The lookup table memory 22 stores such a lookup table. This lookup table has data showing the luminance of the yellow sub pixel Ye corresponding to the luminances Ri, Gi and Bi of the three primary colors represented by the video signal. Here, the luminances Ri, Gi and Bi are obtained by performing inverse γ correction on the gray scale values of the 256-level gray scale scheme. The number of colors which can be specified by the video signal is 256×256×256. The lookup table in the lookup table memory 22 has data of a three-dimensional matrix configuration of 256×256×256, which corresponds to the number of colors which can be specified by the video signal. As a result of reference to the lookup table in the lookup table memory 22, the luminance of the yellow sub pixel Ye corresponding to the luminances Ri, Gi and Bi can be obtained.

The computation section 23 performs a computation by use of the XYZ values obtained by the color coordinate conversion section 21 and the luminance of the yellow sub pixel Ye obtained by the lookup table memory 22 to find the luminances of the red sub pixel R, the green sub pixel G and the blue sub pixel B. Specifically, the computation section 23 performs a computation in accordance with the following expression (2).

[Expression 2]

$$\begin{pmatrix} B \\ R \\ G \end{pmatrix} = \begin{pmatrix} X_R & X_G & X_B \\ Y_R & Y_G & Y_B \\ Z_R & Z_G & Z_B \end{pmatrix}^{-1} \begin{pmatrix} X - (X_{Ye} \times Ye) \\ Y - (Y_{Ye} \times Ye) \\ Z - (Z_{Ye} \times Ye) \end{pmatrix} \tag{2}$$

Now, a reason why the luminances of the red sub pixel R, the green sub pixel G and the blue sub pixel B are found by the computation represented by expression (2) will be described with reference to the following expressions (3) and (4).

[Expression 3]

$$\begin{pmatrix} X \\ Y \\ Z \end{pmatrix} = \begin{pmatrix} X_R & X_G & X_B & X_{Ye} \\ Y_R & Y_G & Y_B & Y_{Ye} \\ Z_R & Z_G & Z_B & Z_{Ye} \end{pmatrix} \begin{pmatrix} R \\ G \\ B \\ Ye \end{pmatrix} \tag{3}$$

[Expression 4]

$$\begin{pmatrix} X \\ Y \\ Z \end{pmatrix} = \begin{pmatrix} X_R & X_G & X_B \\ Y_R & Y_G & Y_B \\ Z_R & Z_G & Z_B \end{pmatrix} \begin{pmatrix} R \\ G \\ B \end{pmatrix} + \begin{pmatrix} X_{Ye} \\ Y_{Ye} \\ Z_{Ye} \end{pmatrix} Ye \tag{4}$$

Assuming that the colors specified by the video signal input to the signal conversion circuit 20 and the colors specified by the multiple primary color signal output from the signal conversion circuit 20 are the same as each other, the XYZ values obtained as a result of conversion made on the luminances Ri, Gi and Bi of the three primary colors are also represented by the matrix conversion expression on the luminances of the red sub pixel R, the green sub pixel G, the blue sub pixel B and the yellow sub pixel Ye as shown in expression (3). Coefficients $X_R$, $Y_R$, $Z_R$ . . . $Z_{Ye}$ of the 3 rows×4 columns conversion matrix shown in expression (3) are determined based on the XYZ values of each sub pixel in the liquid crystal display panel 10.

As shown by expression (4), the right term of expression (3) can be transformed into a sum of the product of the luminances of the red sub pixel R, the green sub pixel G and the blue sub pixel B (represented as R, G and B in the expression) by the 3 rows×3 columns conversion matrix and the product of the luminance of the yellow sub pixel Ye (represented as Ye in the expression) by the 3 rows×1 column conversion matrix. By further transforming expression (4), expression (2) is obtained. This is why the luminances of the red sub pixel R, the green sub pixel G and the blue sub pixel B can be found by performing the computation in accordance with expression (2).

As can be seen, the computation section 23 can obtain the luminances of the red sub pixel R, the green sub pixel G and the blue sub pixel B based on the XYZ values obtained by the color coordinate conversion section 21 and the luminance of the yellow sub pixel Ye obtained by the lookup table memory 22.

As described above, the signal conversion circuit 20 shown in FIG. 23 first finds the luminance of one sub pixel by use of the lookup table stored on the lookup table memory 22, and then finds the luminances of the remaining three sub pixels by means of the computation section 23. Accordingly, the lookup table stored on the lookup table memory 22 does not need to include the data representing the luminances of all of the four sub pixels but merely needs to include the data representing the luminance of one sub pixel among the four sub pixels. Thus, when the structure shown in FIG. 23 is adopted, the lookup table can be configured in a simple manner by use of a small-capacity low-cost memory.

Figure 24:
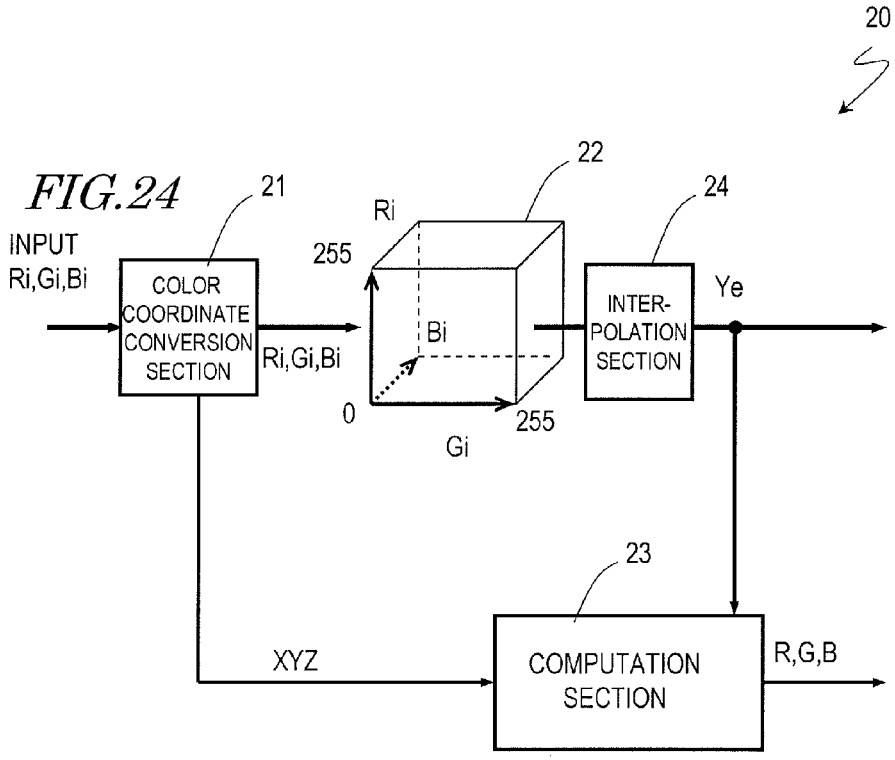
FIG. 24 is a block diagram showing another example of preferable structure of the signal conversion circuit included in the liquid crystal display device 100.
Figure 25:
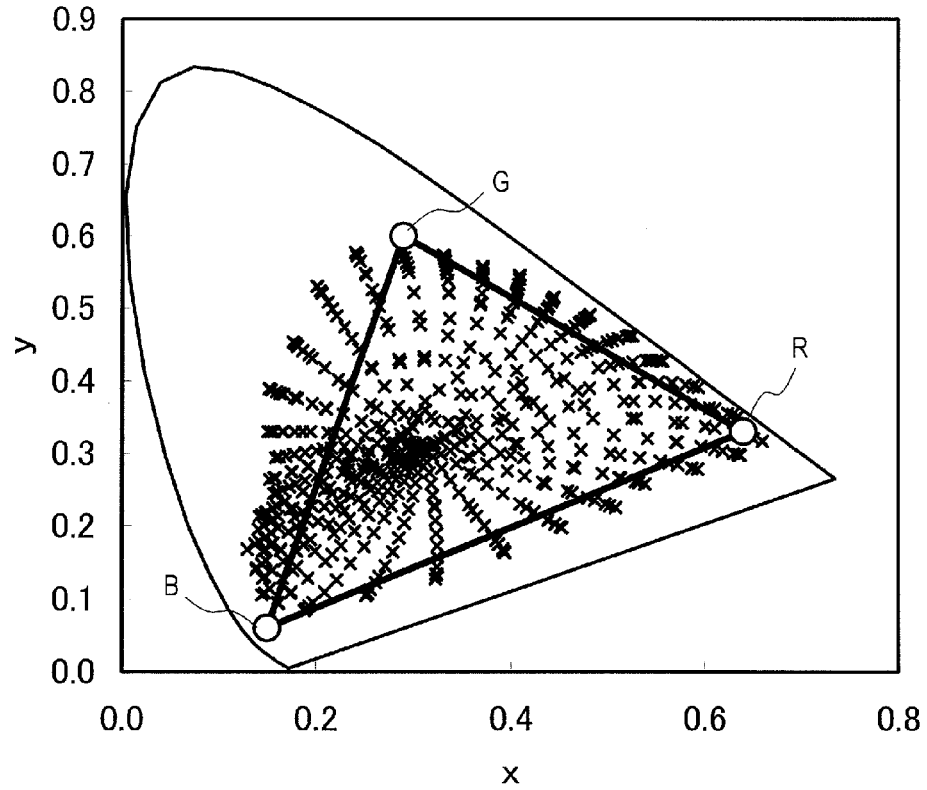
FIG.25 PRIOR ART
FIG. 25 is an xy chromaticity diagram showing a color reproduction range of a conventional display device which provides display by use of the three primary colors.
Figure 26:
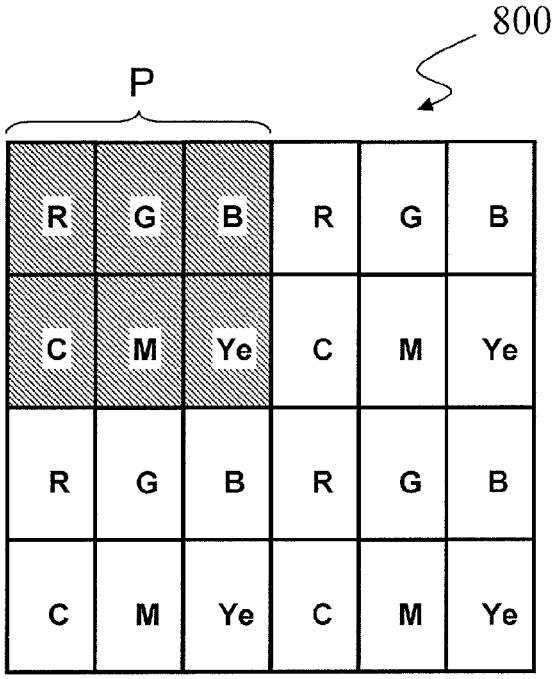
FIG.26 PRIOR ART
FIG. 26 schematically shows a conventional multiple primary color liquid crystal display device 800.
Figure 27:
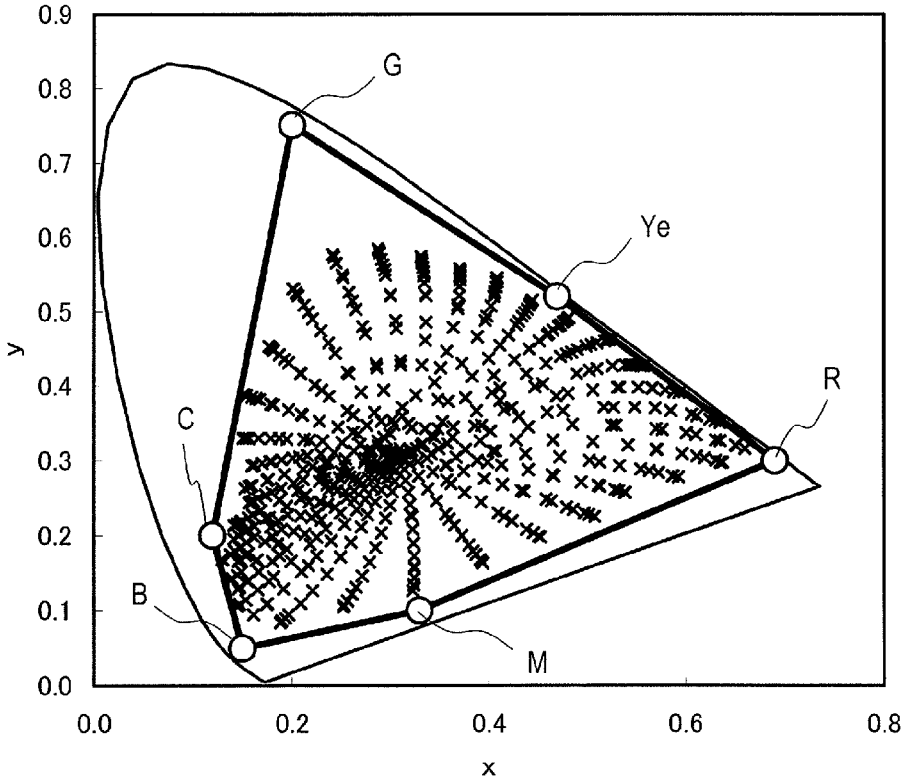
FIG.27 PRIOR ART
FIG. 27 is an xy chromaticity diagram showing a color reproduction range of the multiple primary color liquid crystal display device 800.

FIG. 24 shows another example of preferable structure of the signal conversion circuit 20. Unlike the signal conversion circuit 20 shown in FIG. 23, the signal conversion circuit 20 shown in FIG. 24 includes an interpolation section 24 in addition to the color coordinate conversion section 21, the lookup table memory 22 and the computation section 23.

In the signal conversion circuit 20 shown in FIG. 23, the data in the lookup table stored on the lookup table memory 22 corresponds to the colors of the same number as that of the colors specified by the video signal. By contrast, in the signal conversion circuit 20 shown in FIG. 24, the data in the lookup table corresponds to the colors of a number smaller than that of the colors specified by the video signal.

Here, the luminances Ri, Gi and Bi of the three primary colors represented by the video signal are each of the 256-level gray scale scheme, and the number of colors specified by the video signal is 256×256×256. By contrast, the lookup table in the lookup table memory 22 has data of a three-dimensional matrix configuration of 17×17×17. Each of the luminances Ri, Gi and Bi is of a gray scale scheme including only every 16th level, i.e., levels 0, 16, 32, . . . 256. Namely, the lookup table has 17×17×17 data obtained as a result of culling performed on the 256×256×256 data.

The interpolation section 24 interpolates the luminance of the yellow sub pixel Ye corresponding to each of the culled-out levels by use of the data included in the lookup table (luminance of the yellow sub pixel Ye). For example, the interpolation section 24 performs the interpolation by linear approximation. In this manner, the luminance of the yellow sub pixel Ye corresponding to the luminances Ri, Gi and Bi of the three primary colors can be obtained for each gray scale level.

The computation section 23 finds the luminances of the red sub pixel R, the green sub pixel G and the blue sub pixel B by use of the XYZ values obtained by the color coordinate conversion section 21 and the luminance of the yellow sub pixel Ye obtained by the lookup table 22 and the interpolation section 24.

As described above, in the signal conversion circuit 20 shown in FIG. 24, the number of colors corresponding to the data in the lookup table stored on the lookup table memory 22 is smaller than the number of colors specified by the video signal. Therefore, the data amount in the lookup table can be further decreased.

In the above example, the lookup table includes the data representing the luminance of the yellow sub pixel Ye and the computation section 23 finds the luminances of the remaining red sub pixel R, the green sub pixel G and the blue sub pixel B. The present invention is not limited to this. As long as the lookup table includes data representing the luminance of any one sub pixel, the computation section 23 can find the luminances of the remaining three sub pixels.

The elements included in the signal conversion circuit 20 are realized by hardware, or a part thereof or the entirety thereof may be realized by software. When these elements are realized by software, a computer may be used. Such a computer includes a CPU (Central Processing Unit) for executing various programs, a RAM (Random Access Memory) acting as a work area for executing such programs, and the like. A program for realizing the functions of the elements is executed by the computer, and the computer is operated as the elements.

The program may be provided to the computer from a storage medium, or may be provided to the computer via a communication network. The storage medium may be structured to be separable from the computer or incorporated into the computer. The storage medium may be mounted on the computer such that a program code stored thereon can be directly read by the computer, or may be mounted on the computer as an external storage device such that the program can be read via a program read device connected to the computer. The storage device may be, for example, a tape such as a magnetic tape, a cassette tape or the like; a disc such as a magnetic disc, for example, a flexible disc, a hard disc or the like, a magneto-optical disc, for example, an MO, an MD or the like, or an optical disc, for example, a CD-ROM, a DVD, a CD-R or the like; a card such as an IC card (including a memory card), an optical card or the like; or a semiconductor memory such as a mask ROM, an EPROM (Erasable Programmable Read Only Memory), an EEPROM (Electrically Erasable Programmable Read Only Memory), a flash ROM or the like. In the case where the program is provided via a communication network, the program may be in the form of a carrier wave or a data signal which embodies the program code by electronic transfer.

In the above, the liquid crystal display device is described as an example. The present invention is preferably usable to any of various types of display devices including CRTs (cathode ray tubes), organic EL display devices, plasma display panels, SEDs (Surface-conduction Electron-emitter Displays) and the like as well as liquid crystal display devices.

INDUSTRIAL APPLICABILITY

According to the present invention, a multiple primary color display device which suppresses decline of the display quality when an input signal corresponding to green of the sRGB color space is externally input. The present invention is preferably usable especially to a four primary color display device which provides display by use of red, green, blue and yellow. A multiple primary color display device according to the present invention can provide high quality display, and therefore is preferably usable to any of various electronic devices including liquid crystal TVs.

REFERENCE SIGNS LIST

10 Liquid crystal display panel
20 Signal conversion circuit
21 Color coordinate conversion section
22 Lookup table memory
23 Computation section
24 Interpolation section
100 Liquid crystal display device

The invention claimed is:

1. A display device comprising a pixel defined by a plurality of sub pixels, wherein:

the plurality of sub pixels are a red sub pixel to display red, a green sub pixel to display green, a blue sub pixel to display blue, and a yellow sub pixel to display yellow; and when an input signal corresponding to green of an sRGB color space is externally input from outside the display device, an image is provided on the display device by the green sub pixel and the yellow sub pixel; wherein an increase in ratios of gray scale levels of the green sub pixel and the yellow sub pixel with respect to an increase of the gray scale level of the input signal is different between a first range of the gray scale level of the input signal from a minimum level to a prescribed intermediate level and a second range of the gray scale level of the input signal from the prescribed intermediate level to a maximum level.

2. The display device of claim 1, wherein when the gray scale level of the input signal is the prescribed intermediate level, the gray scale level of the green sub pixel is the maximum level, and the increase ratio of the green sub pixel in the second range is zero.

3. The display device of claim 2, wherein in the first range, hue, chroma and lightness of green corresponding to the input signal substantially match the hue, chroma and lightness of a color displayed by the pixel.

4. The display device of claim 3, wherein in the second range, the lightness of the green corresponding to the input signal substantially matches the lightness of the color displayed by the pixel.

5. The display device of claim 4, wherein in the second range, the hue of the green corresponding to the input signal substantially matches the hue of the color displayed by the pixel.

6. The display device of claim 3, wherein when the input signal is input, in the second range, display is provided by use of the green sub pixel, the yellow sub pixel and the blue sub pixel.

7. The display device of claim 3, wherein when the input signal is input, in the second range, the blue sub pixel is not used for display.

8. The display device of claim 3, wherein in the second range, the lightness of the color displayed by the pixel is lower than the lightness of the green corresponding to the input signal.

9. The display device of claim 8, wherein in the second range, the hue of the green corresponding to the input signal substantially matches the hue of the color displayed by the pixel.

10. The display device of claim 3, wherein in the second range, the hue, chroma and lightness of the color displayed by the pixel are constant.

11. The display device of claim 3, wherein in the second range, the increase ratio of the yellow sub pixel is zero.

12. The display device of claim 1, wherein the prescribed intermediate level is a gray scale level at which, when a Y value of white displayed by the pixel in an XYZ colorimetric system is 1, the Y value of green corresponding to the input signal is 0.3 or greater.

13. A display device comprising a pixel defined by a plurality of sub pixels, wherein:

the plurality of sub pixels are a red sub pixel to display red, a green sub pixel to display green, a blue sub pixel to display blue, and a yellow sub pixel to display yellow; and when an input signal corresponding to green of an sRGB color space is externally input from outside the display device, an image is provided on the display by the green sub pixel in a first range of a gray scale level of the input signal from a minimum level to a prescribed intermediate level, and the image is provided on the display by the green sub pixel and the yellow sub pixel in a second range of the gray scale level of the input signal from the prescribed intermediate level to a maximum level.

14. The display device of claim 13, wherein an increase ratio of the gray scale level of the green sub pixel with respect to an increase of the gray scale level of the input signal is different between in the first range and in the second range.

15. The display device of claim 14, wherein when the gray scale level of the input signal is the prescribed intermediate level, the gray scale level of the green sub pixel is the maximum level, and the increase ratio of the green sub pixel in the second range is zero.

16. The display device of claim 13, wherein the prescribed intermediate level is a gray scale level at which, when a Y value of white displayed by the pixel in an XYZ colorimetric system is 1, the Y value of green corresponding to the input signal is 0.3 or greater.

17. The display device of claim 13, wherein when the prescribed intermediate level is a first intermediate level, an increase ratio of the gray scale level of the green sub pixel with respect to an increase of the gray scale level of the input signal is different between in a third range of the gray scale level of the input signal from the minimum level to a second intermediate level which is higher than the first intermediate level and in a fourth range of the gray scale level of the input signal from the second intermediate level to the maximum level.

18. The display device of claim 17, wherein when the gray scale level of the input signal is the second intermediate level, the gray scale level of the green sub pixel is the maximum level, and the increase ratio of the green sub pixel in the fourth range is zero.

19. The display device of claim 17, wherein the first intermediate level is a gray scale level at which, when a Y value of white displayed by the pixel in an XYZ colorimetric system is 1, the Y value of the green corresponding to the input signal is 0.3 or greater.

20. The display device of claim 1, wherein when the gray scale level of the input signal is a maximum level, chromaticities x and y and a Y value in an XYZ colorimetric system of a color displayed by the pixel fulfill the relationships of $0.25 \leq x \leq 0.35$, $0.45 \leq y \leq 0.70$ and $0.3 \leq Y \leq 0.8$ where the Y value when the pixel displays white is 1.

* * * * *